US006477945B1

(12) United States Patent
Imanishi et al.

(10) Patent No.: US 6,477,945 B1
(45) Date of Patent: Nov. 12, 2002

(54) DOUBLE-ACTION MECHANICAL PRESS

(75) Inventors: Shouzou Imanishi, Sagamihara (JP); Junkichi Gomikawa, Sagamihara (JP)

(73) Assignee: Aida Engineering, Ltd., Kanagawa (JP)

( * ) Notice: Subject to any disclaimer, the term of this patent is extended or adjusted under 35 U.S.C. 154(b) by 0 days.

(21) Appl. No.: 09/520,191

(22) Filed: Mar. 7, 2000

(30) Foreign Application Priority Data

Sep. 7, 1999 (JP) ..... 11-253387

(51) Int. Cl.[7] ..... B30B 5/00

(52) U.S. Cl. ..... 100/264; 100/257; 100/258 R; 100/281; 100/282; 72/451; 425/451.6

(58) Field of Search ..... 100/264, 281, 100/282, 257, 258 R, 254; 72/407, 408, 451; 425/352, 354, 355, 451.6

(56) References Cited

U.S. PATENT DOCUMENTS

| | | | | | |
|---|---|---|---|---|---|
| 1,986,410 | A | * | 1/1935 | Rode | 72/408 |
| 2,071,001 | A | * | 2/1937 | Rode et al. | 72/408 |
| 2,532,320 | A | * | 12/1950 | Maussnest | 100/282 |
| 2,633,765 | A | * | 4/1953 | Glasner | 72/451 |
| 2,771,790 | A | * | 11/1956 | Munschauer | 100/282 |
| 3,772,986 | A | * | 11/1973 | Kawagoshi et al. | 100/282 |
| 3,797,327 | A | * | 3/1974 | Voorhees et al. | 100/292 |
| 3,808,912 | A | * | 5/1974 | Voorhees et al. | 100/282 |
| 4,238,950 | A | * | 12/1980 | Carrieri et al. | 72/407 |
| 4,276,823 | A | * | 7/1981 | Rotzler | 100/282 |
| 5,136,875 | A | * | 8/1992 | Schockman | 100/282 |
| 5,287,728 | A | * | 2/1994 | Yoshida | 100/257 |
| 5,852,970 | A | * | 12/1998 | Bornhost et al. | 100/282 |

FOREIGN PATENT DOCUMENTS

| | | |
|---|---|---|
| GB | 2 307 435 A | 5/1997 |
| JP | 9-285897 | 11/1997 |

* cited by examiner

*Primary Examiner*—John Sipos
*Assistant Examiner*—Louis Huynh
(74) *Attorney, Agent, or Firm*—Oliff & Berridge, PLC

(57) ABSTRACT

A double-action mechanical press is capable of easily keeping the dynamic balance, simpler in structure and provides an improved processing accuracy by maintaining the parallelism in upper and lower rams. The double-action mechanical press has a crank mechanism within a double-action crown. The crank mechanism comprises a crankshaft having two of first eccentric sections and two of second eccentric sections. A bed includes two oppositely rotatable toggle linkage mechanisms which rotate oppositely from one another. The two first eccentric sections are connected to the upper ram to move it in the upward and downward directions. The two of second eccentric sections are connected to the lower ram through a plurality of upright rods with the two toggle linkage mechanisms to move the lower ram in the upward and downward directions.

9 Claims, 21 Drawing Sheets

DOUBLE-ACTION MECHANICAL PRESS

BACKGROUND OF THE INVENTION

1. Field of the Invention

The present invention relates to a double-action mechanical press capable of upward and downward movement an upper ram and a lower ram while both movements are related each other by a common driving source.

2. Related Art

As an example, a double-action mechanical press has been used to shape a blank into a cup-like configuration and then draw the bottom of the cup-shaped material while holding the position of the upper flange of the cup-shaped material in the upward and downward directions to form a cylindrical-shape of a beverage can.

For example, Japanese Patent Application Laid-Open No. 9-285897 discloses a conventional double-action mechanical press which comprises an upper ram continuously movable in the upward and downward directions and a lower ram associated with the upper ram to stop at a given position for a given time period, as show in FIG. 8.

This conventional double-action mechanical press has two drive linkage mechanisms disposed on the both sides of a frame. These two drive linkage mechanisms can be rotated by a single crankshaft in the forward and backward directions of the frame at its central position. Each of the drive linkage mechanisms includes an upper link for driving upward and downward the upper ram and a lower link for driving upward and downward the lower ram.

In such a double-action mechanical press of the conventional art, however, it is very difficult to keep its dynamic balance since large components force in a forward and backward directions exert onto the two drive linkage mechanisms. The both rams are moved upward and downward by the two drive linkage mechanisms at the central position of the frame extending forward and backward. To maintain the parallelism (or horizontal degree) of each ram, thus, 4 guideposts for the ram need to be strong. In addition, it is necessary that the drive linkage mechanism keeps the whole dynamic balance including the dynamic balances of both the rams in their forward and backward directions. Thus, the drive linkage mechanisms must be connected to other linkage mechanisms exclusive for the dynamic balance. This tends to make the double-action mechanical press complicated and upsized. Furthermore, the balance weight must be increased. In general, it is difficult to improve the stroke per minute (SPM) and accuracy of finishing.

In the conventional press, the respective mechanisms themselves in the press must be modified or adjusted to change the slide stroke diagram of the lower ram. The adjustment of die height must carefully be performed through a complicated operation while the operation of the press is stopping, since it should be set by a die-height adjusting device incorporated into the slide section of the press. Since the die-height adjusting device itself incorporated into the slide section of the press becomes a load on the driving source, the press will have no choice but to upsize.

SUMMARY OF THE INVENTION

It is thus an objective of the present invention to provide a double-action mechanical press of such a simplified structure that can easily keep the dynamic balance and that can ensure an improved SPM and accuracy of finishing by maintaining the parallelism in each ram.

Another objective of the present invention is to provide a double-action mechanical press which can disperse a load corresponding to the reaction force from the lower ram toward the driving source and which can simplify the supporting structure of the lower ram to reduce the manufacturing cost.

Still another objective of the present invention is to provide a double-action mechanical press which can adjust the die height and also change the slide stroke in the lower ram with no modification to the mechanism and without provision of any load onto the driving source.

In one aspect, the present invention provides a double-action mechanical press comprising:

a driving source;

a crank mechanism driven by the driving source, the crank mechanism including a crankshaft which has two of first eccentric sections and two of second eccentric sections;

an upper ram being moved upward and downward by the power from the first eccentric sections;

a lower ram being moved upward and downward by the power from the second eccentric sections;

a plurality of upright rods for transmitting the power from each of the second eccentric sections in the crank mechanism; and two toggle linkage mechanisms each of which rotates in the opposite direction from each other in a vertical plane by the power inputted through the plurality of upright rods to move the lower ram in the upward and downward directions.

For example, if the crank mechanism, in a crown is driven according to this aspect of the present invention, the upper ram connected to the first eccentric sections which are spaced rightward and leftward, for example, through connecting rods or the like can be moved upward and downward. This crank mechanism will not cause any unbalance in the rightward and leftward directions. Since it is only required to keep the rotational balance, therefore, the structure of keeping the dynamic balance will be simpler.

The second eccentric sections in the crank mechanism moves the lower ram upward and downward by rotating the toggle linkage mechanisms oppositely from each other in the rightward and leftward directions in a bed through the upright rods. At this time, the upper position of the lower ram may be its retention position. Since each of the toggle linkage mechanisms are oppositely rotated from each other in the rightward and leftward directions, the parallelism in the lower ram can be maintained without making the guideposts more rugged.

In other words, the dynamic components in the rightward and leftward directions may be counteracted by each other since two toggle linkage mechanisms which are spaced rightward and leftward are oppositely rotated in the rightward and leftward directions. Each of the toggle linkage mechanisms will be simplified in structure since only the dynamic balance in the upward and downward moving member may be kept. In such a manner, the present invention can provide a double-action mechanical press of such a simplified structure that can easily keep the dynamic balance and that can ensure an improved SPM and accuracy of finishing by maintaining the parallelism in each ram.

In this aspect, the driving source may include a pair of driving sources for applying a rotational force onto both ends of the crankshaft. Thus, the pair of driving sources can function as a dual-system brake to more improve the safety and rightward and leftward balance.

The crankshaft may further include two of third eccentric sections for driving balance weights. In such a case, a rotational phase difference may be provided between the first eccentric sections and the second eccentric sections. At this time it is preferable that the third eccentric sections are disposed at positions (Pe) opposite to eccentric positions (Pc) about the crankshaft, the eccentric positions (Pc) being composition of masses of eccentric positions (Pa) of the first eccentric sections and eccentric positions (Pb) of the second eccentric sections.

Thus, the rotational balance in the crankshaft can be kept even if any phase difference is provided between the upper and lower rams when driven.

According to this aspect of the present invention, the lower ram being moved upward and downward may be retained at its upper position.

In another aspect, the present invention provides a double-action mechanical press comprising:

a driving source;

two crank mechanisms driven by the driving source, each of the crank mechanisms including a crankshaft which has a first eccentric section and a second eccentric section;

a plurality of upright rods for transmitting the power from the second eccentric section of each of the crank mechanisms;

an upper ram being moved upward and downward by the power from the plurality of upright rods;

a lower ram being moved upward and downward by the power from the second eccentric section of each of the crank mechanisms; and two toggle linkage mechanisms receiving the power from the second eccentric section of each of the crank mechanisms and rotating in the opposite direction from each other in a vertical plane to move the lower ram in the upward and downward directions.

When both the crank mechanisms are rotated through main gear or the like, the upper ram is moved upward and downward by the respective first eccentric sections, for example, through the upper-ram-driving connecting rods and upright rods. Such an upward and downward movement of the upper ram will not produce any unbalance in the rightward and leftward directions. Therefore, the dynamic balance can perfectly be kept, for example, by mounting a balance weight on the main gear.

Since each of the toggle linkage mechanisms are oppositely rotated from each other in the rightward and leftward directions by the second eccentric sections driven at the same time of the above motion, the toggle linkage mechanisms can move the lower ram upward and downward. At this time, the upper position of the lower ram may be its retention position.

Since the toggle linkage mechanisms which are spaced rightward and leftward are oppositely rotated in the rightward and leftward directions, the dynamic components in the rightward and leftward (or horizontal) directions can be counteracted by each other. In other words, the dynamic balance in the upward and downward directions may also be kept in the lower ram. For example, a balance weight may simply be mounted on each of the toggle linkage mechanisms opposite to the connection portion to the lower-ram-driving connecting rods.

This aspect of the present invention can also provide a double-action mechanical press of such a simplified structure that can easily keep the dynamic balance and that can ensure an improved SPM and accuracy of finishing by maintaining the parallelism in each ram. Unlike the first mentioned aspect, this aspect can eliminate a crown on the upper part of the machine. Therefore, the press can be downsized. And also, the lubricating oil will not leak onto the pressed products. In addition, the oil treating system may be simplified in structure.

The driving source may include a pair of driving sources each for applying a rotational power to each of the crankshafts, one of the pair of driving sources applying a rotational power to one of the crankshafts, and the other one of the pair of driving sources applying a rotational power to the other one of crankshafts. In this case, it is preferable each of the crankshafts includes two pinion gears fixedly mounted thereon at both ends. Thus, two pinion gears fixed at one end of each of the crankshafts may mesh each other while other two pinion gears fixed at the other end of each of the crankshafts mesh each other. As a result, the pair of driving sources will function as a double-system brake to more improve the safety and rightward and leftward balance.

It is preferable that the toggle linkage mechanisms have two main gears meshing the pinion gears fixedly mounted on the crankshafts, and that each of the main gears includes a balance weight fixedly mounted thereon.

When two main gears rotated in the opposite directions from each other include balance weights fixedly mounted thereon, all the mass balances in the upper and lower rams moved upward and downward for a sine curve (STU) as shown in FIG. 13 can be kept.

It is further preferable that each of the toggle linkage mechanisms has a balance weight.

According to this aspect, the dynamic components in the rightward and leftward (or horizontal) directions may be counteracted by each other since the toggle linkage mechanisms are rotated oppositely from each other. This can provide an extremely simplified structure only by mounting balance weights for keeping the balance in the upward and downward directions in the lower ram or the like on the two toggle linkage mechanisms.

Even in this embodiment of the present invention, the lower ram being moved upward and downward is retained at the upper position thereof.

In a further aspect of the present invention, two toggle linkage mechanisms of the double-action mechanical press may comprise a common toggle point shaft.

Since the system span can be reduced in any small-sized press producing fewer products, two toggle linkage mechanisms can be disposed making a toggle point shaft in common. When the two toggle linkage mechanisms are oppositely rotated from each other about the common toggle point shaft in the rightward and leftward directions, the dynamic components in the rightward and leftward (or horizontal) directions can surely be counteracted by each other.

Preferably, each of the toggle linkage mechanisms comprises: a swing arm swinging about the common toggle point shaft as a fulcrum; a lower-ram-driving connecting rod connecting between the second eccentric section and the swing arm; and a connecting link connecting the lower ram and the swing arm, and the swing arm, the lower-ram-driving connecting rod and the connecting link substantially form an inverted Y-shaped configuration.

Thus, a reaction force F corresponding to the load from the lower ram can be dispersed into components F1 and F2 toward the driving source, as shown in FIG. 14. At the same time, the pressing operation can be accelerated by rotating the second eccentric sections at an increased speed.

It is further preferable that the double-action mechanical press comprises mechanism for adjusting the upward and downward positions of the common toggle point shaft.

Thus, the die height, lower ram motion and slide stroke can be changed by adjusting the upward and downward positions of the common toggle point shaft relative to the two toggle linkage mechanisms.

DESCRIPTION OF THE PREFERRED EMBODIMENTS

Preferred embodiments of the present invention will now be described with reference to the drawings.

(First Embodiment)

Figure 1:
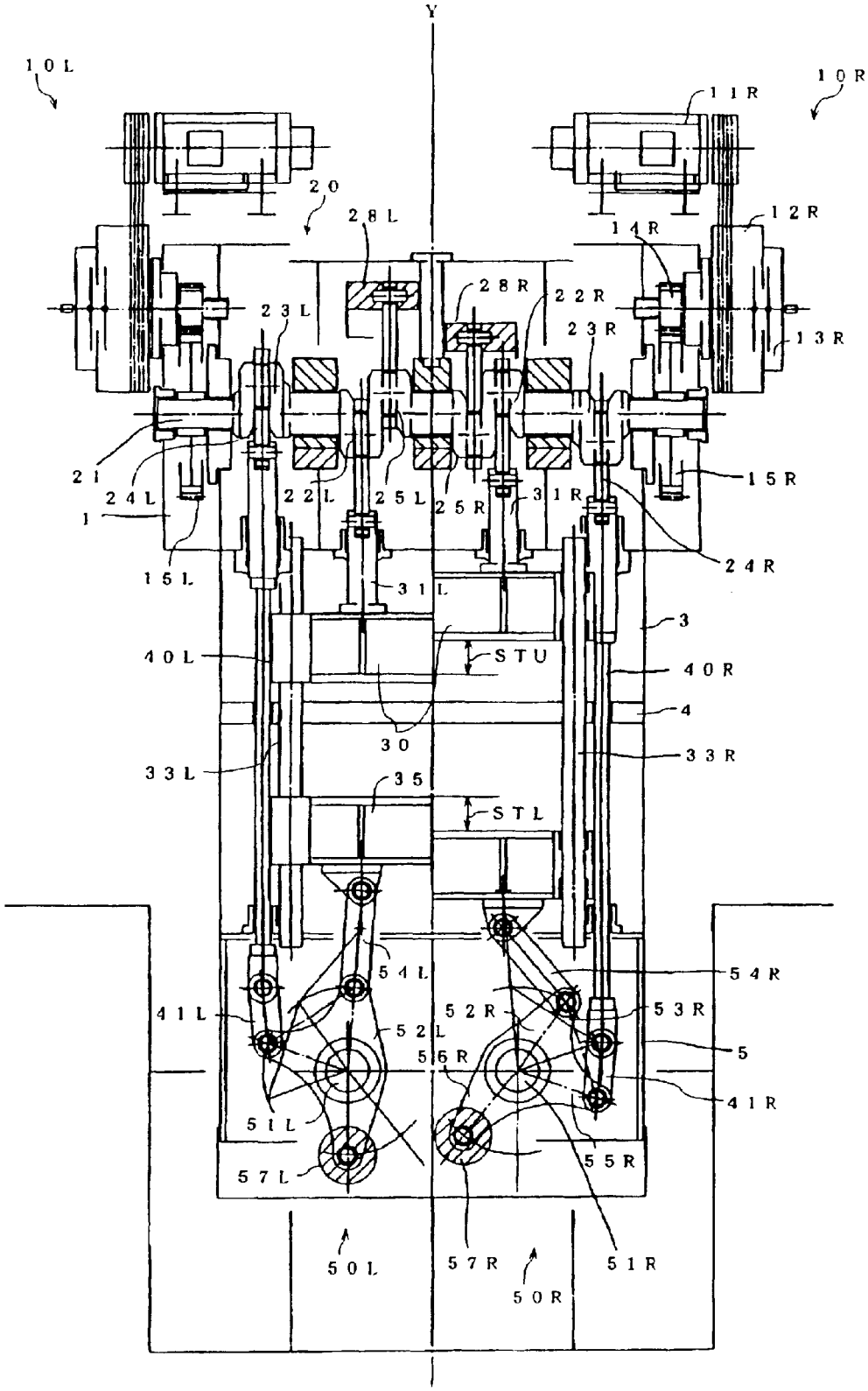
FIG. 1 is a front view of a double-action mechanical press according to a first embodiment of the present invention.
Figure 2:
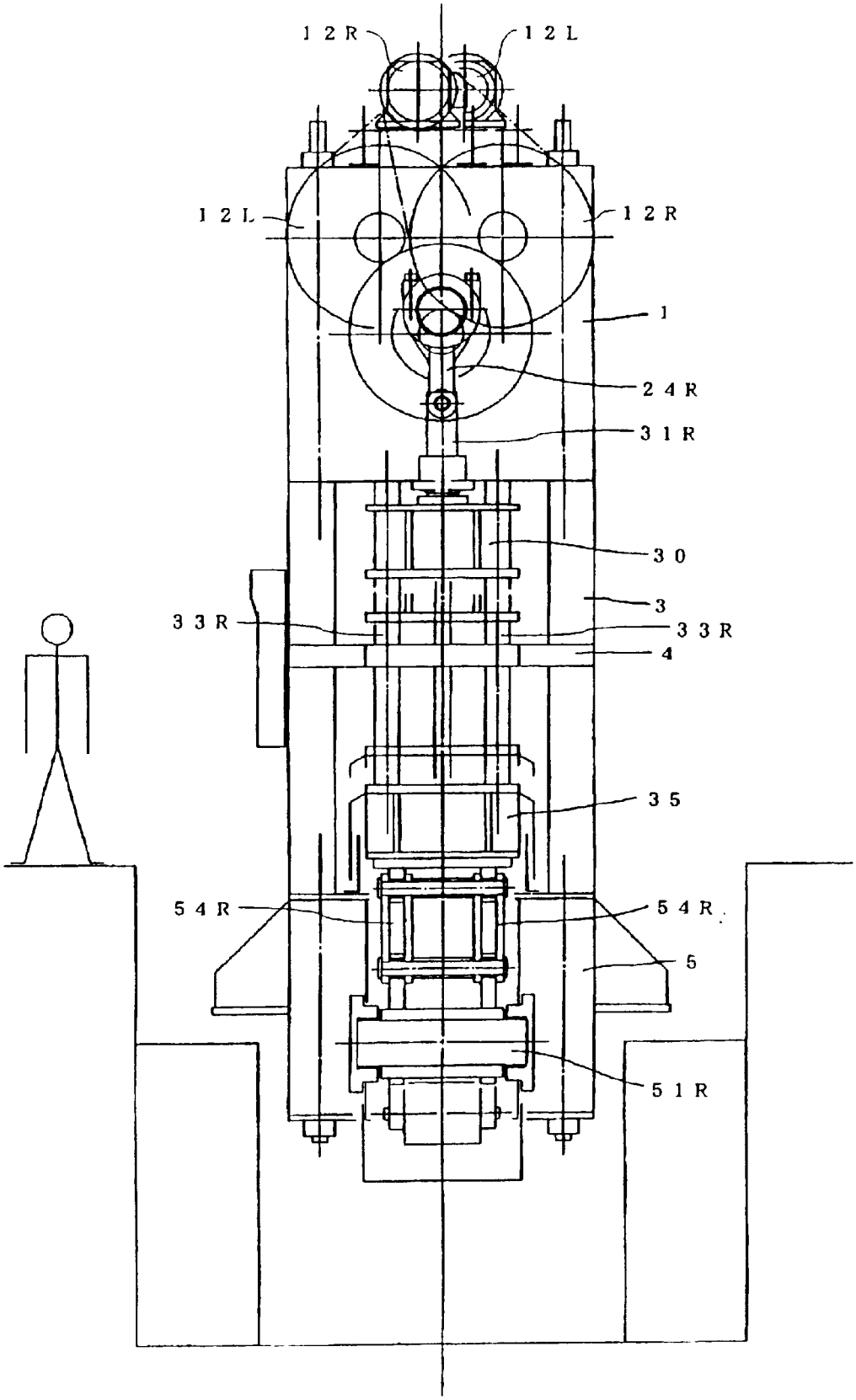
FIG. 2 is a side view of the double-action mechanical press shown in FIG. 1 as viewed from the right side.

Referring now to FIGS. 1 and 2, a double-action mechanical press constructed according to a first embodiment of the present invention comprises a crank mechanism 20 having two first eccentric sections 22L, 22R for driving an upper ram and two second eccentric sections 23L, 23R for driving a lower ram. Each of the first eccentric portions and each of the second eccentric portions are spaced away from one another in rightward and leftward directions within a crown 1. The double-action mechanical press also comprises a bed 5 in which two toggle linkage mechanisms 50L and 50R are spaced away from each other in the rightward and leftward directions. These toggle linkage mechanisms rotate oppositely from each other in the rightward and leftward directions in the vertical plane. The second eccentric sections 23L and 23R are respectively connected to the toggle linkage mechanisms 50L and 50R through upright rods 40L and 40R, respectively. Thus, a lower ram 35 is movable upward and downward such that the upper position of the lower ram 35 can be in its retention position.

Referring to FIG. 1, the main body of the press comprises the crown 1 which is the upper part of the press, the bed 5 which is the lower part of the press and columns 3 connecting the crown 1 and the bed 5. Reference numeral 4 designates a bridge.

The left side of FIG. 1 about an axis Y shows the bottom dead center while the right side represents the top dead center. The affixed letters "L" and "R" represent the left- and right-side components, respectively.

The crank mechanism 20 including a crankshaft 21 extending in the rightward and leftward directions is disposed within the crown 1. The crankshaft 1 may be replaced by an eccentric shaft or the like.

A symmetric structure is formed by the first eccentric sections 23L and 23R, the second eccentric sections 22L and 22R, upper-ram and the third eccentric sections 25L and 23R respectively located on the left side and right side of the central press axis Y in the crankshaft. More particularly, the first eccentric sections 22L and 22R are respectively located on the left and right sides of the crankshaft 21 at their central location. Each of the second eccentric sections 23L or 23R is disposed outside of the corresponding first eccentric section 22L or 22R while each of the third eccentric sections 25L or 25R for driving a balance weight is arranged inside of the corresponding first eccentric section 22L or 22R.

As will be apparent from FIGS. 1 and 2, an upper ram 30 is slidably guided in the upward and downward directions by four guide posts 33 (33L, 33L, 33R, 33R) and connected to the first eccentric sections 22L and 22R through plungers 31L, 31R and connecting rods.

The second eccentric sections 23L and 23R are connected to upright rods 40L and 40R through connecting rods 24L and 24R, respectively. The relationship between the second eccentric sections 23L, 23R and the toggle linkage mechanisms 50L, 50R and so on will be described later in more detail.

The third eccentric sections 25L and 25R are respectively connected to balance weights 28L and 28R through connecting rods. These balance weights 28L and 28R are smaller-sized and simple in structure since they are selected to have minimum weight (mass) equivalent to the difference from the total weight of the moving members (30, 31L, 31R, 40L, 40R, etc.) which are moved upward and downward along a sine curve (STU) shown in FIG. 7A due to the phase shift (=135 degrees) between the first eccentric sections 22L and 22R and the second eccentric sections 23L and 23R.

In the first embodiment, a driving source 10 comprises a pair of driving sources 10L and 10R which are spaced rightward and leftward to improve the safety and rightward and leftward balance in a dual-system brake. The right-side driving source 10R comprises a motor 11R, a flywheel 12R, a clutch brake 13R and a main gear 15R connected through a pinion gear 14R. The left-side driving source 10L is of similar structure.

In other words, the driving source 10 provides a symmetric dual-system drive train which is synchronized each other through the crankshaft 21. Thus, it will not be required that the driving source 10 is connected to the other drive shaft.

Within the bed 5, the toggle linkage mechanisms 50L and 50R are disposed opposed to each other about the axis Y. The toggle linkage mechanisms 50L and 50R comprise a pair of toggles 52L and 52R extending in the forward and backward directions shown in FIG. 1 and mounted on right and left toggle point shafts 51L and 51R of FIG. 1. The toggles 52L and 52R rotate oppositely from each other in the rightward and leftward directions in synchronism.

In the right toggle linkage mechanism 50R, the drive end 55R of the toggle 52R is connected to the upright rod 40R through the connecting rod 41R, and the upper end 53R is connected to the lower ram 35 through an upper toggle link 54R. The lower end 56R located opposite to the upper end 53R includes a balance weight 57R mounted thereon for the lower ram 35 that is movable upward and downward along a toggle curve (STL) shown in FIG. 7B. The left toggle linkage mechanism 50L is of similar structure.

The toggle linkage mechanisms 50L, 50R (or 52L, 52R) are symmetrically disposed by facing each other and synchronously rotated in the rightward and leftward directions (i.e. right rotational direction and left rotational direction in FIG. 1) about the toggle point (shaft) 51L, 51R. Therefore, the dynamic components force in the rightward and leftward (or horizontal) directions can be counteracted by each other. Thus, the balance weights 57L and 57R may only be used to keep the upward and downward motion balance in the lower ram 35 and so on.

In other words, the double-action mechanical press of the present invention does not require any balance-weight driving linkage other than the toggle linkage mechanisms that was required in the prior art, and may be extremely simple in structure.

The toggle linkage mechanisms 50L, 50R (or 52L, 52R) are synchronously rotated rightward and leftward directions at the central positions of toggle shafts (fulcrum) 51L, 51R in the forward and backward directions. Therefore, the lower ram 35 can be supported to be driven by the four upper toggle links 54. As a result, the double-action mechanical press can be formed to be stronger for the load eccentricity in the forward and backward directions and to maintain the parallelism (or horizontal degree) of the lower ram 35. In addition, the guide posts 33 can be formed more simply.

In this configuration, the phase difference between the first eccentric sections 22L, 22R and the second eccentric sections 23L, 23R is 135 degrees, and the third eccentric sections 25L and 25R are positioned at the midpoint in the remaining angle 225 (360−135) degrees. Although the phase difference of 135 degrees is not essential, it is preferred in this embodiment since the mass of the balance weights 28L, 28R can be minimized to keep the rotational balance in the crankshaft 21 as described.

Figure 3:
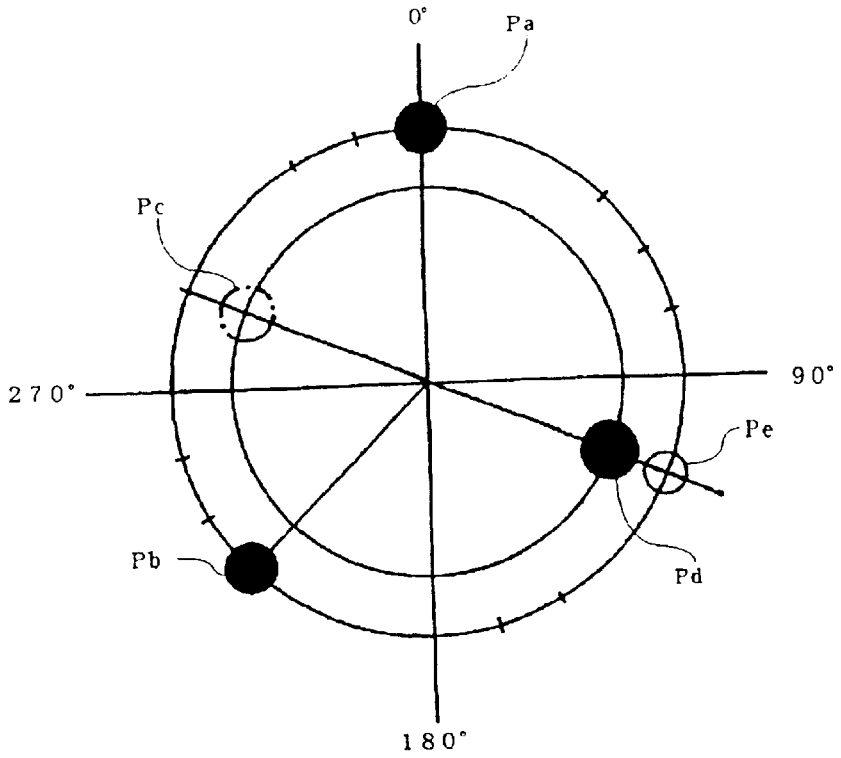
FIG. 3 is a view illustrating the eccentrically positional relationship in the double-action mechanical press of FIG. 1.
Figure 4:
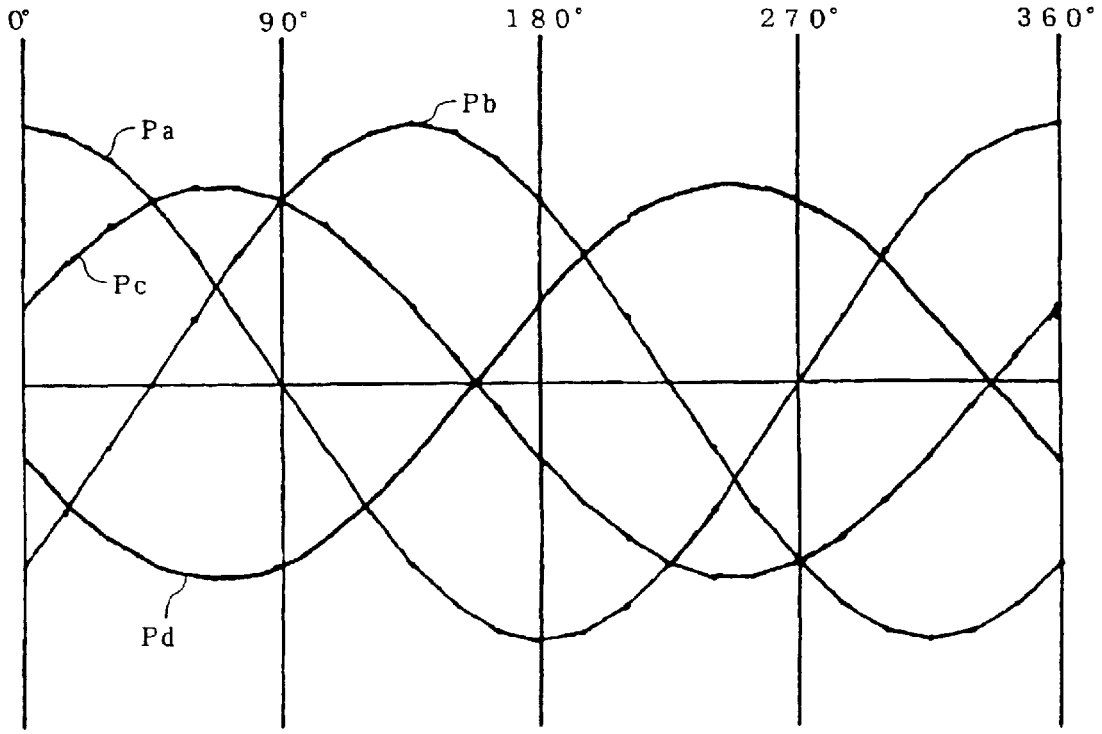
FIG. 4 is a view illustrating the phase shift based on FIG. 3.

Such a setting provides interrelationships as shown in FIG. 3 among the eccentric position Pa of the upper ram 30, the eccentric position Pb of the lower ram, the eccentric position Pc of the combined mass of the eccentric positions Pa and Pb, the eccentric position Pd opposed to Pc and the eccentric position Pe obtained when the rotational radius of Pd is equal to those of Pa and Pb. The respective changes of phase are as shown in FIG. 4. The mass of the eccentric position Pe is equal to the mass obtained by 0.77 times the eccentric position Pa (=Pb). This eccentric position Pe becomes the position of each of the third eccentric sections 25L and 25R.

Figure 5:
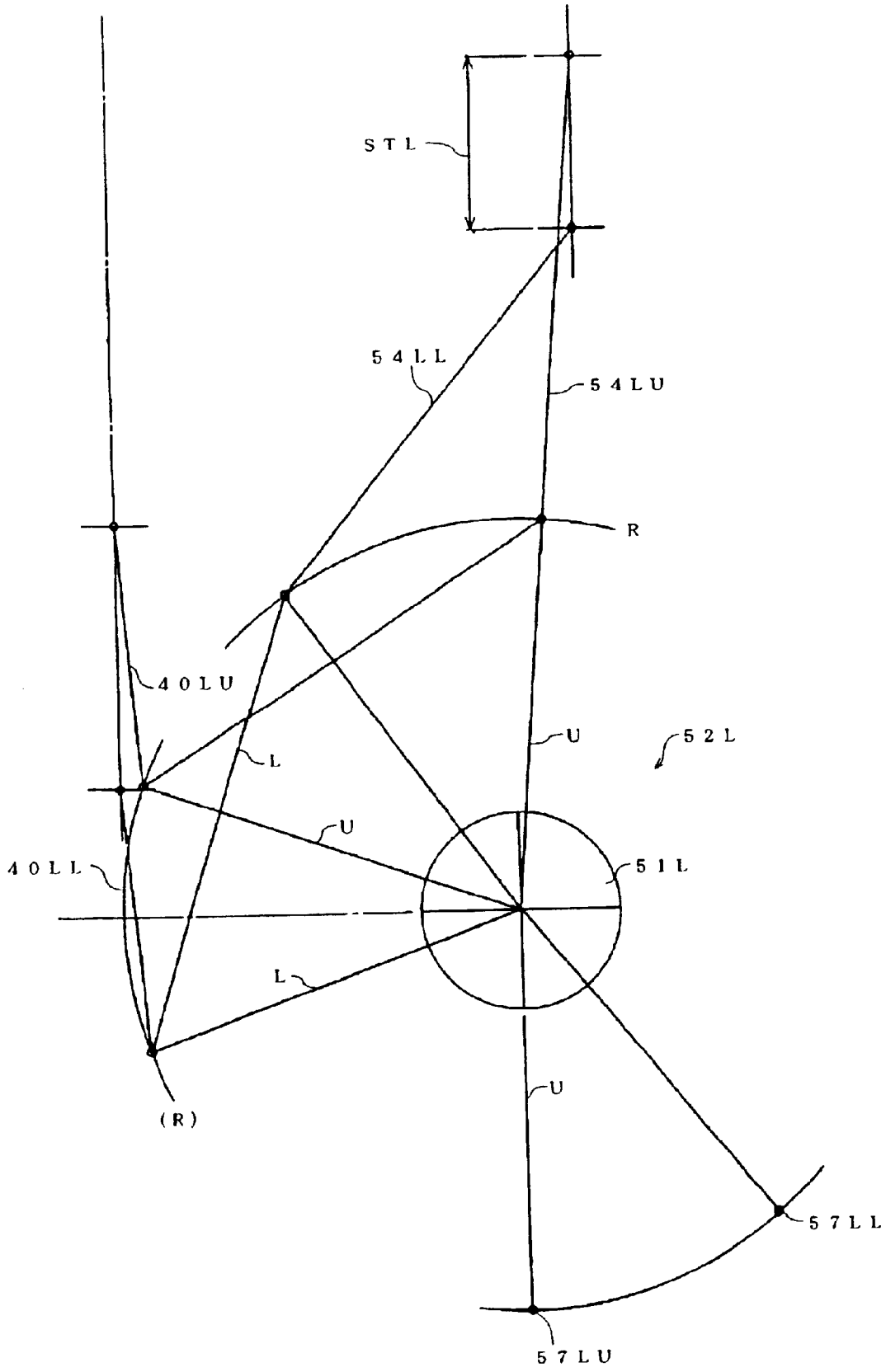
FIG. 5 is a view illustrating the relationship between the actuated toggle linkage mechanism and the lower ram stroke in the first embodiment of the present invention.

In such a manner, the relationships between the crank mechanism 20 (or upright rods 40L, 40R) and the toggle linkage mechanisms 50L, 50R are determined such that the lower ram 35 can be moved upward and downward by the stroke STL so that the upper position of the lower ram 35 can be the retention position thereof, as shown in FIG. 5.

In relation with the left toggle linkage mechanism 50L, for example, FIG. 5 shows the interrelationships among the upright rod 40L, the toggle point 51L, the toggle 52L and the balance weight 57L when the letters "U" and "L" represent the upward and downward positions of the lower ram 35, respectively. Lines shown only by the letters "L" and "U" are for convenience in comparison and for facilitating the understanding.

Figure 6B:
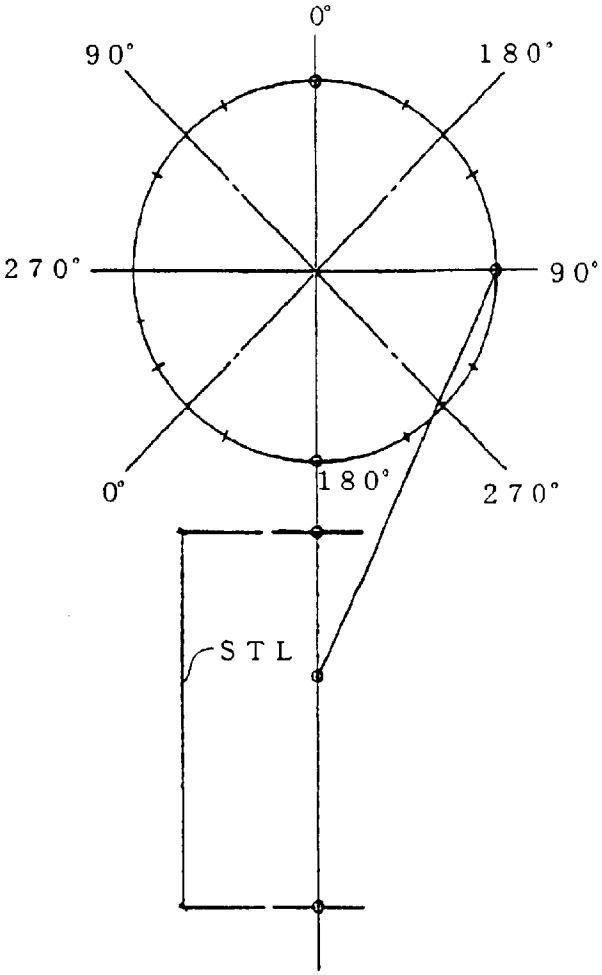
FIGS. 6A and 6B are views illustrating the stroke phase shift between the upper and lower rams in the first embodiment of the present invention.
Figure 6A:
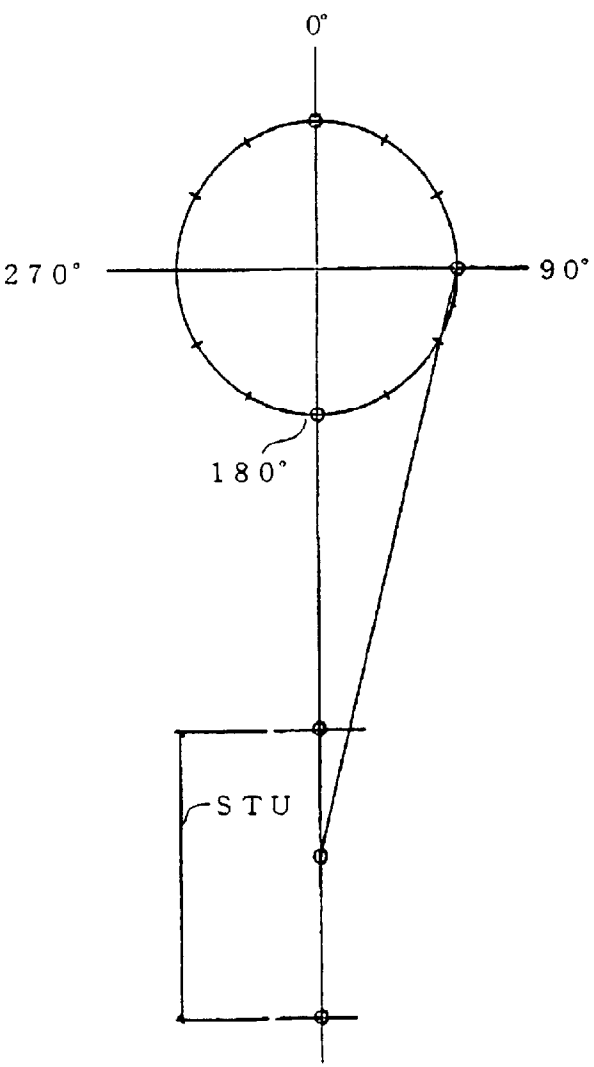

The stroke STL of the lower ram 35 thus advances by the phase difference equal to 135 degrees, which is the phase difference of the second eccentric section 23 relative to the first eccentric section 22 as shown by one-dot-and-chain line in FIG. 6B, relative to the relationship between the rotational angle of the crankshaft 21 (or the first eccentric section 22) and the stroke STU of the upper ram 30 as shown in FIG. 6A.

Figure 7A:
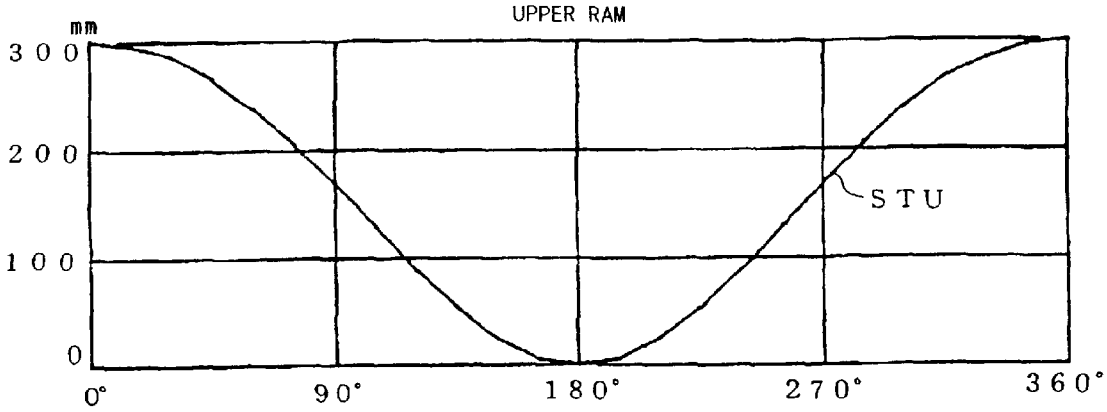
FIGS. 7A and 7B are views illustrating the drawing area in the first embodiment of the present invention.
Figure 7B:
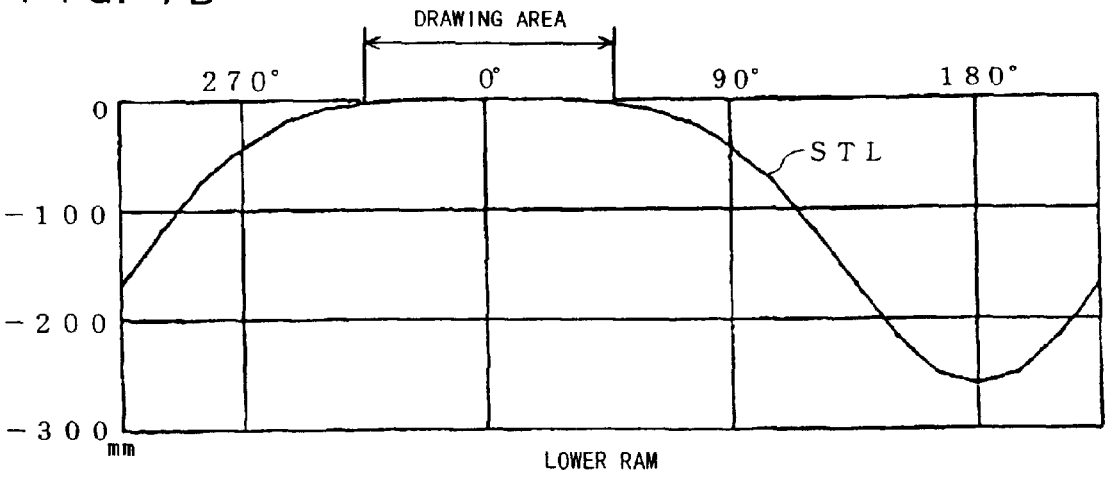

In other words, the stroke diagram of the lower ram 35 becomes a toggle diagram (STL) in which the upper position shown in FIG. 7B has a retention or drawing area and is followed by a sharp descending line, unlike the stroke diagram (STU) of the upper ram 30 approximating to a sine curve as shown in FIG. 7A.

In such an arrangement, the ratio (L/R) of a radius (R) of the crank and a length (L) of the connecting rod for driving both the upper and lower rams 30, 35 can be reduced. Therefore, the drawing area determined by the relative position between the upper and lower rams 30, 35 can be increased. As a result, the pressing operation can be improved in speed by reducing the stroke STU of the upper ram 30 or the retention time of the lower ram 35.

(Second Embodiment)

Figure 8:
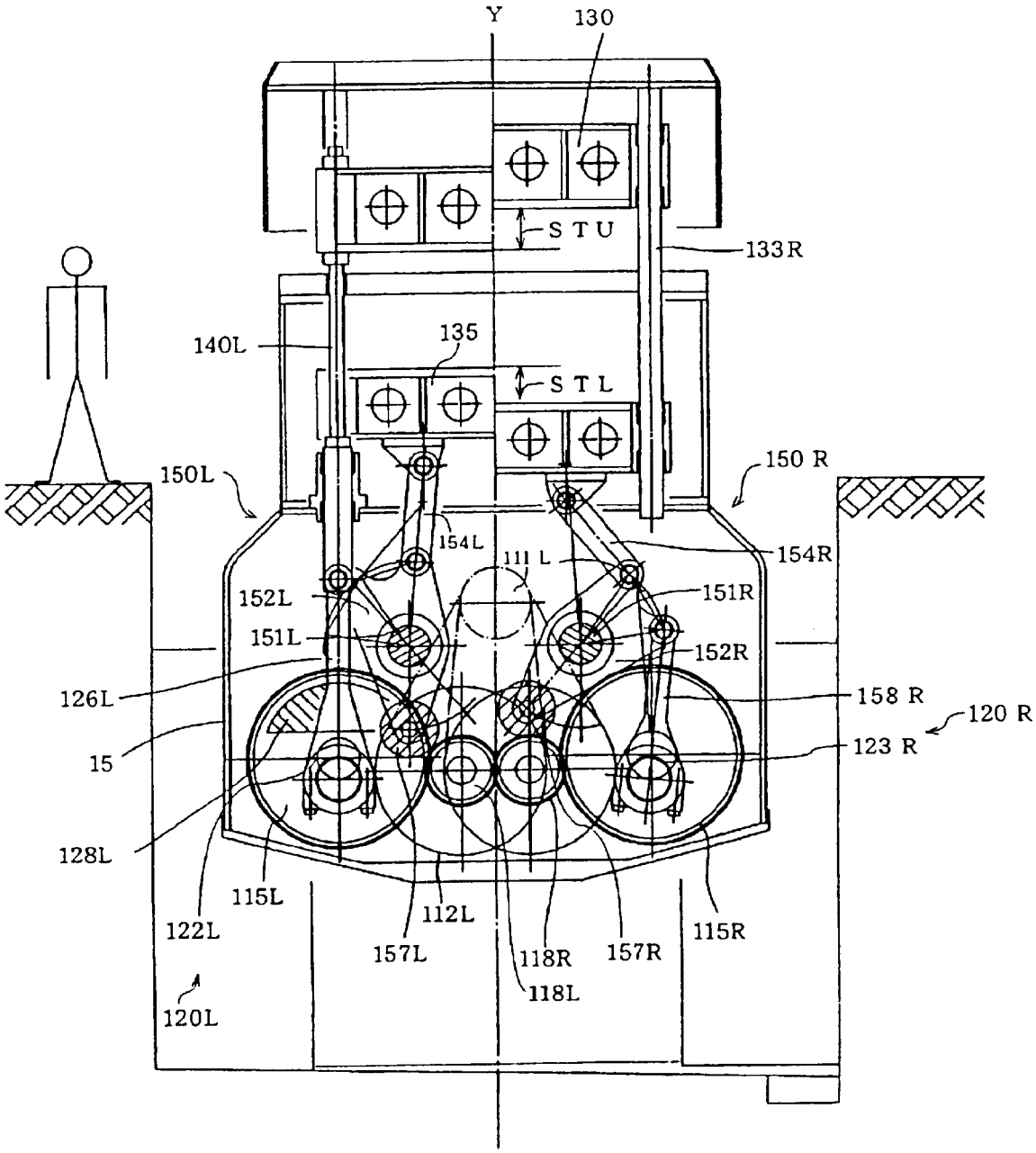
FIG. 8 is a front view of a double-action mechanical press according to a second embodiment of the present invention.
Figure 9:
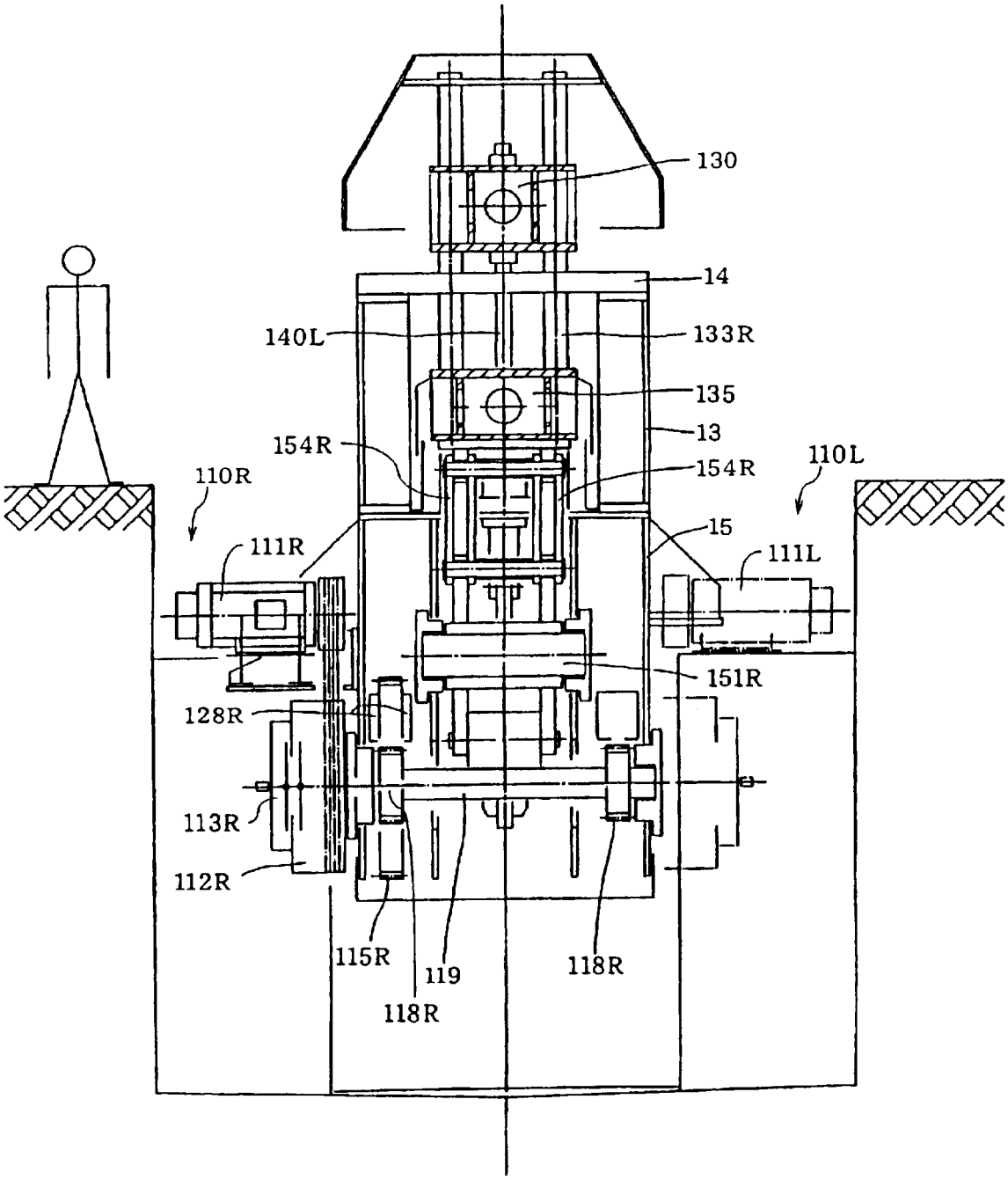
FIG. 9 is a side view of the double-action mechanical press shown in FIG. 8 as viewed from the right side.
Figure 10:
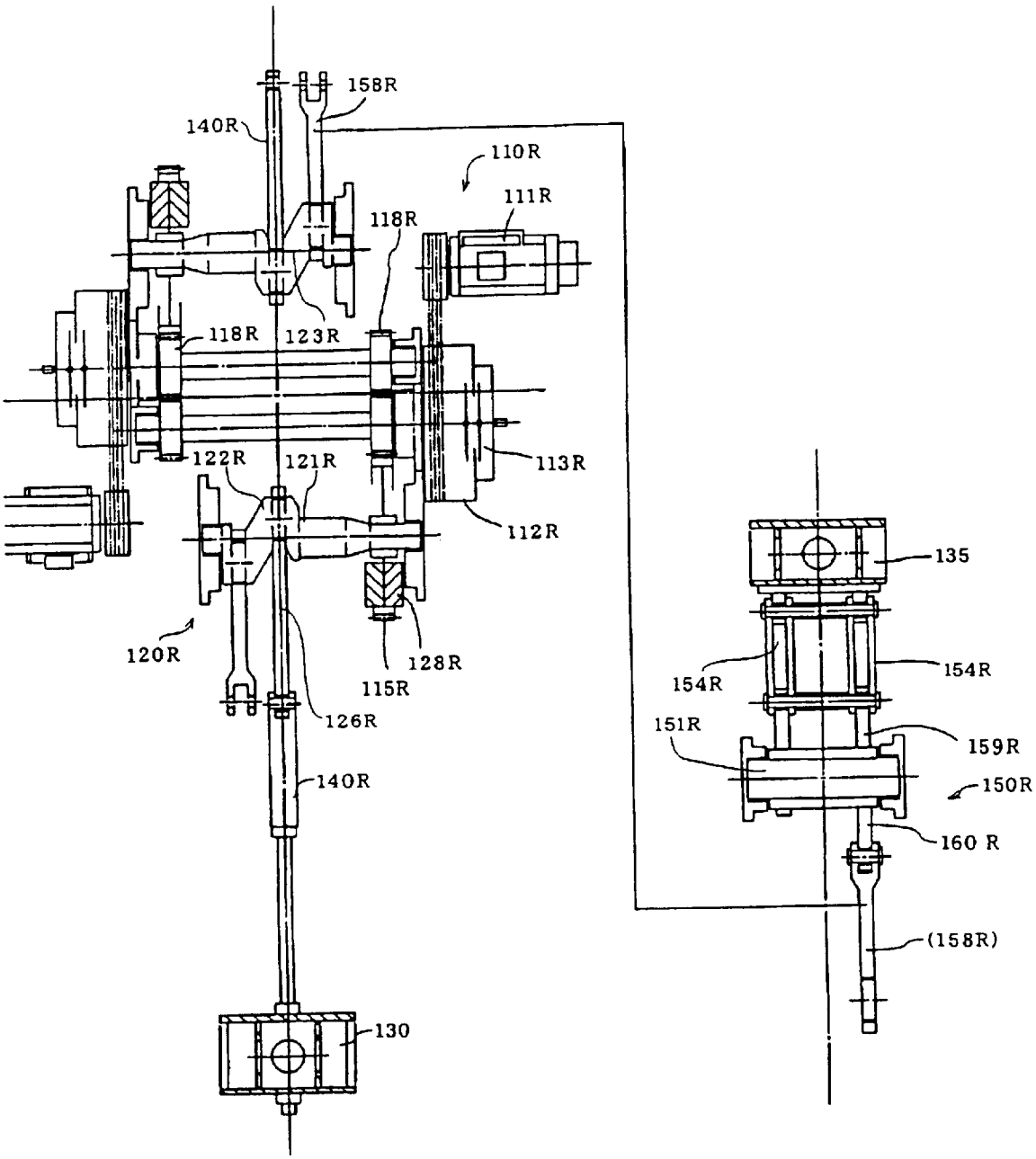
FIG. 10 is an exploded cross-sectional view illustrating the details of the driving system and the like of the double-action mechanical press shown in FIG. 8.

A second embodiment of the present invention is shown in FIGS. 8 to 11. According to the second embodiment, a double-action mechanical press comprises a bed 15 including two crank mechanisms 120L, 120R and two toggle linkage mechanisms 150L, 150R. Each of the crank mechanisms 122L or 122R has a first eccentric section 122L or 122R for driving an upper ram and a second eccentric section 123L or 123R for driving a lower ram, which are located away from each other in the forward and backward directions on a crankshaft 121L or 121R. An upper ram 130 can be moved upward and downward by connecting the third eccentric section 122L or 122R for driving a balance weight of the crank mechanism 120L or 120R to the upper ram 130 through the upper-ram-driving connecting rod 126L or 126R and upright rod 140L or 140R as shown in FIG. 10.

The second eccentric section 123L or 123R is connected to a toggle linkage mechanism 150R or 150L through a lower-ram-driving connecting rod 158R or 158L. In such an arrangement, the lower ram 135 can be moved in the upward and downward directions such that it will be retained at its upper position.

Parts similar to those of the first embodiment (FIGS. 1 to 7) are designated by the same reference numerals, but will simply or not further be described.

It will be apparent from FIGS. 8 and 9 that the pairs of crank mechanisms 120L, 120R and toggle linkage mechanisms 150L, 150R are disposed opposed to one another within the bed 15. Thus, the crown 1 is omitted to reduce the whole height of the machine. As a result, the manufacturing cost can also be reduced since the columns, tie-rods and so on in the bed 15 can be eliminated.

In the second embodiment, similarly, the driving source comprises a pair of driving sources 110L and 110R which are spaced rightward and leftward to form a double-system brake providing an improved safety. Right main gear 115R and left main gear 115L are meshed by each other and synchronously rotated in the opposite direction from each other through four pinion gears 118L, 118R which are connected by a pinion shaft 119.

Figure 13:
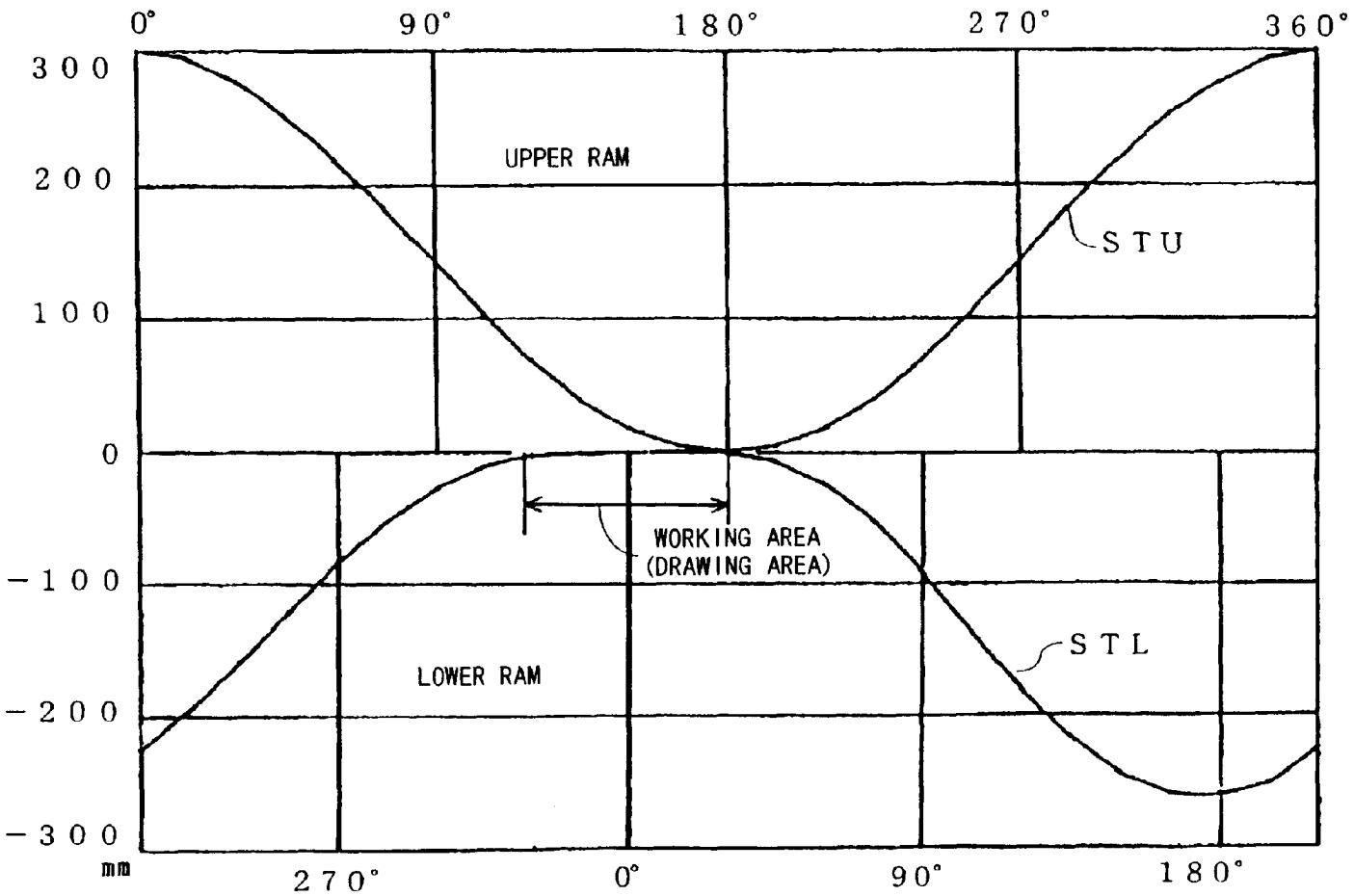
FIG. 13 is a view illustrating the stroke phase shift between the upper and lower rams and drawing area thereof in the double-action mechanical press according to the second embodiment of the present invention.

The main gears 115L and 115R oppositely rotated from each other include balance weights 128L and 128R (128R is omitted) mounted thereon as shown in FIG. 8 for keeping the whole mass balance of the members moved upward and downward along a sine curve (STU) as shown in FIG. 13.

Figure 11:
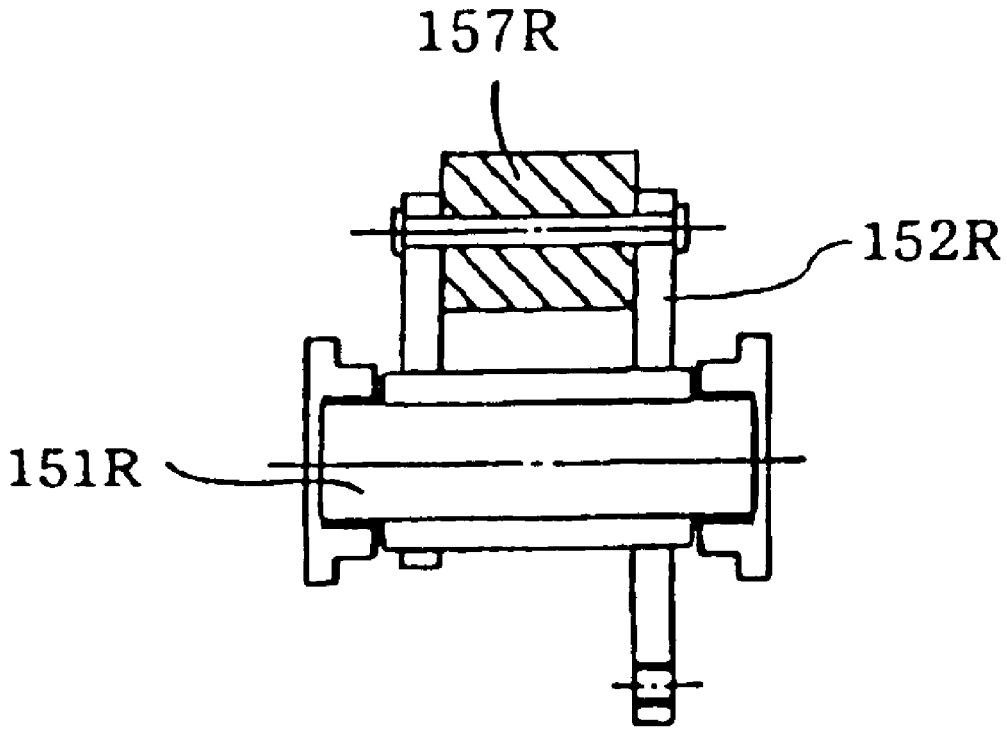
FIG. 11 is a view illustrating the mounting of a balance weight for the lower ram of the double-action mechanical press shown in FIG. 8.

Also in the second embodiment, the toggle linkage mechanisms 150L, 150R (or 152L, 152R) located symmetrically opposed to each other in the rightward and leftward directions are rotated oppositely from each other in the rightward and leftward directions (or right rotational direction and left rotational direction in FIG. 8) about the toggle points (shafts) 151L, 151R. As a result, the dynamic components force in the rightward and leftward (or horizontal) directions can be counteracted by each other. Therefore, the balance weights 157L, 157R may only be used to keep the vertical balance in the lower ram 135 and so on, and may only be mounted on the toggles 152L, 152R as shown in FIG. 11. This provides an extremely simplified structure.

The lower ram 135 is supported by four toggle links 154 to be stronger against the load eccentricity in the forward and backward directions and to maintain the parallelism (or horizontal degree). The guide posts 133 can be simplified in structure.

Considering the right side of the machine, for example, the crank mechanism 120R or 123R is connected to the lower ram 135 through the toggle linkage mechanism 150R by lower-ram-driving connecting rod 158R, toggle driving arm 160R, lower toggle link 159R and upper toggle link 154R.

Figure 12A:
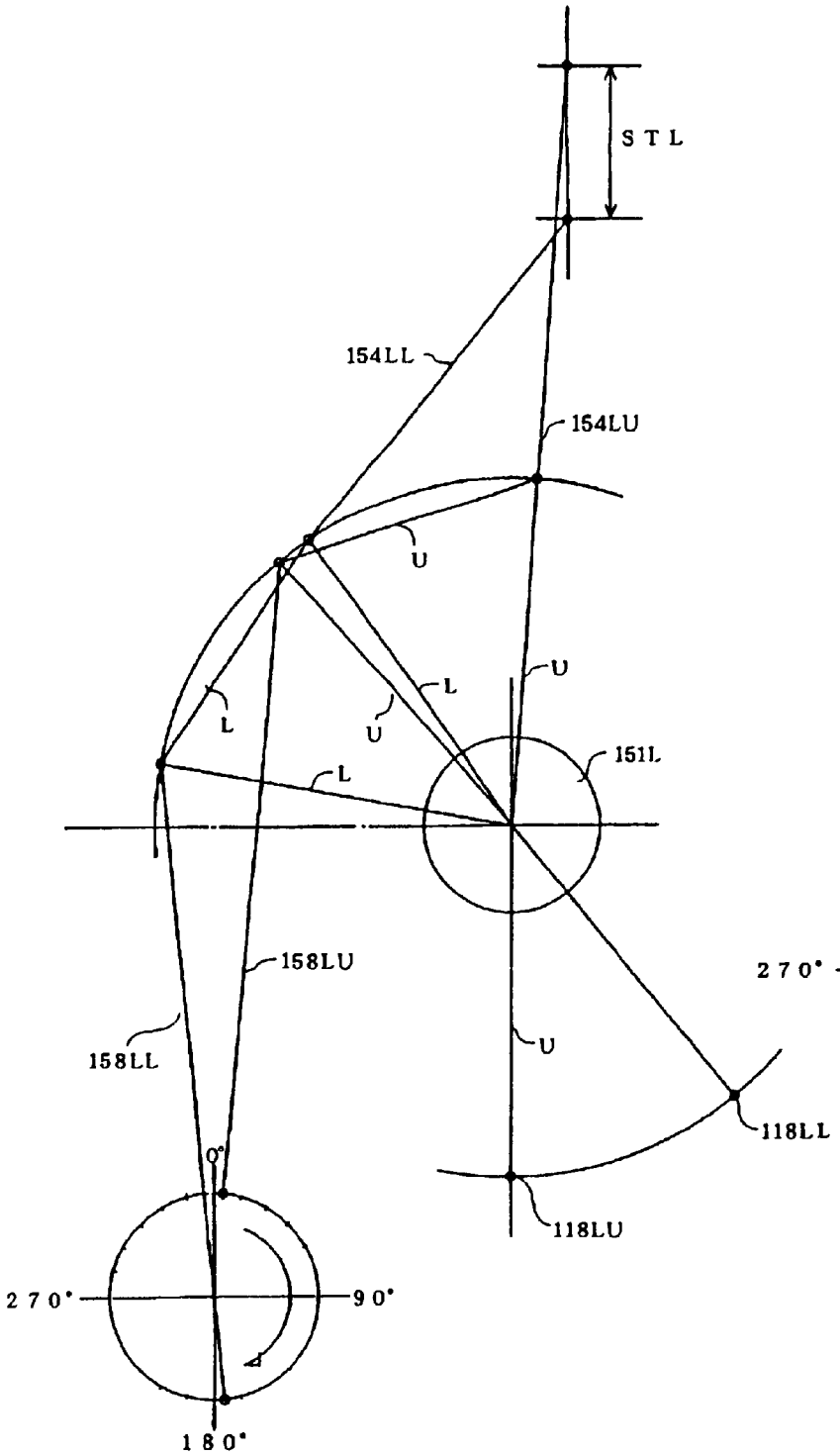
FIGS. 12A and 12B are views mainly illustrating the relationship between the operation of the toggle linkage mechanism and the stroke of the lower ram in the double-action mechanical press according to the second embodiment of the present invention.
Figure 12B:
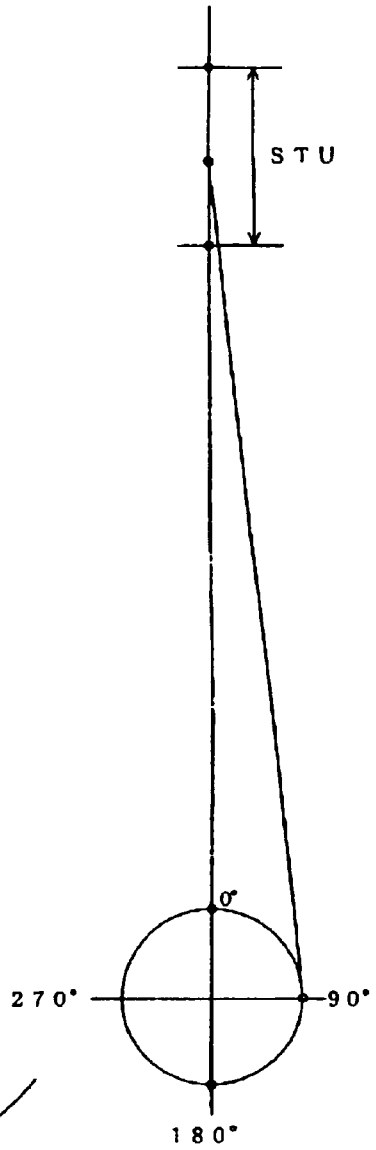

In other words, the upper and lower rams 130, 135 can be moved upward and downward by the driving sources 110L, 110R rotate in the opposite direction from each other under a relationship as shown in FIGS. 12 and 13 which corresponds to the first embodiment (FIGS. 5 to 7). FIG. 12A shows the side of lower ram while FIG. 12B represents the side of upper ram.

In such a manner, the double-action mechanical press according to the second embodiment can have the same functions and advantages as in the first embodiment and also eliminate the crown on the upper part of the machine. In addition, the double-action mechanical press can prevent any leaked lubricant oil from the upper part from depositing on the pressed products and can have a simplified oil processing system.

(Third Embodiment)

A third embodiment of the present invention is shown in FIGS. 14 to 18. The third embodiment is similar to the second embodiment. More particularly, the third embodiment provides a double-action mechanical press comprises a bed 25 including two crank mechanisms 220L, 220R and two toggle linkage mechanisms 250L, 250R. Each of the crank mechanisms 220L or 220R has a first eccentric section 222L or 222R for driving an upper ram and a second eccentric section 223L or 223R for driving a lower ram, which are located away from each other on a crankshaft 221L or 221R. An upper ram 230 can be moved upward and downward by connecting the first eccentric section 222L or 222R to the upper ram 230 through the upper-ram-driving connecting rod 226L or 226R and upright rod 240L or 240R as shown in FIG. 10. The second eccentric section 223L or 223R is connected to a toggle linkage mechanism 250R or 250L through a lower-ram-driving connecting rod 258R or 258L.

Therefore, the third embodiment can provide the same advantages as in the second embodiment.

The third embodiment is different from the second embodiment only in that the third embodiment provides a single toggle point shaft 251 common for two toggle linkage mechanisms 250L, 250R, unlike the second embodiment in which each of the two toggle linkage mechanisms 250L or 250R has one toggle point shaft 251L or 251R.

Although the double-action mechanical press according to the second embodiment has been described as to a large-sized structure in which, for example, eight beverage cans are simultaneously processed into cylindrical configuration through a single pressing step, the double-action mechanical press according to the third embodiment may be of such a small-sized structure as only two cans, for example, are worked through a single pressing step. Thus, in the double-action mechanical press according to the third embodiment a space between each of connecting links 254L, 254R, which are connected to a lower ram 235, can be reduce. This provides a single common toggle point shaft 251.

Each of the toggle linkage mechanisms 250L or 250R includes a swing arm 252L or 252R swinging about the toggle point shaft 251, an lower-ram-driving connecting rod 258L or 258R connecting the second eccentric section 223L or 223R and the swing arm 252L or 252R, and a connecting link 254L or 254R connecting the lower ram 235 and the swing arm 252L or 252R. The swing arm 252L (252R), lower-ram-driving connecting rod 258L (258R) and connecting link 254L (254R) substantially form an inverted Y-shape.

In such a toggle linkage mechanism 250L or 250R, the rotational power of the second eccentric section 223L or 223R is inputted as a linear reciprocating force by the lower-ram-driving connecting rod 258L or 258R. As a result, the swing arm 252L or 252R is swung about the toggle point shaft 251. The lower ram 235 connected to the swing arm 252L or 252R through the connecting link 254L or 254R is moved upward and downward by the motion of swing arm 252L or 252R along a stroke diagram approximating to sine curve.

Figure 14:
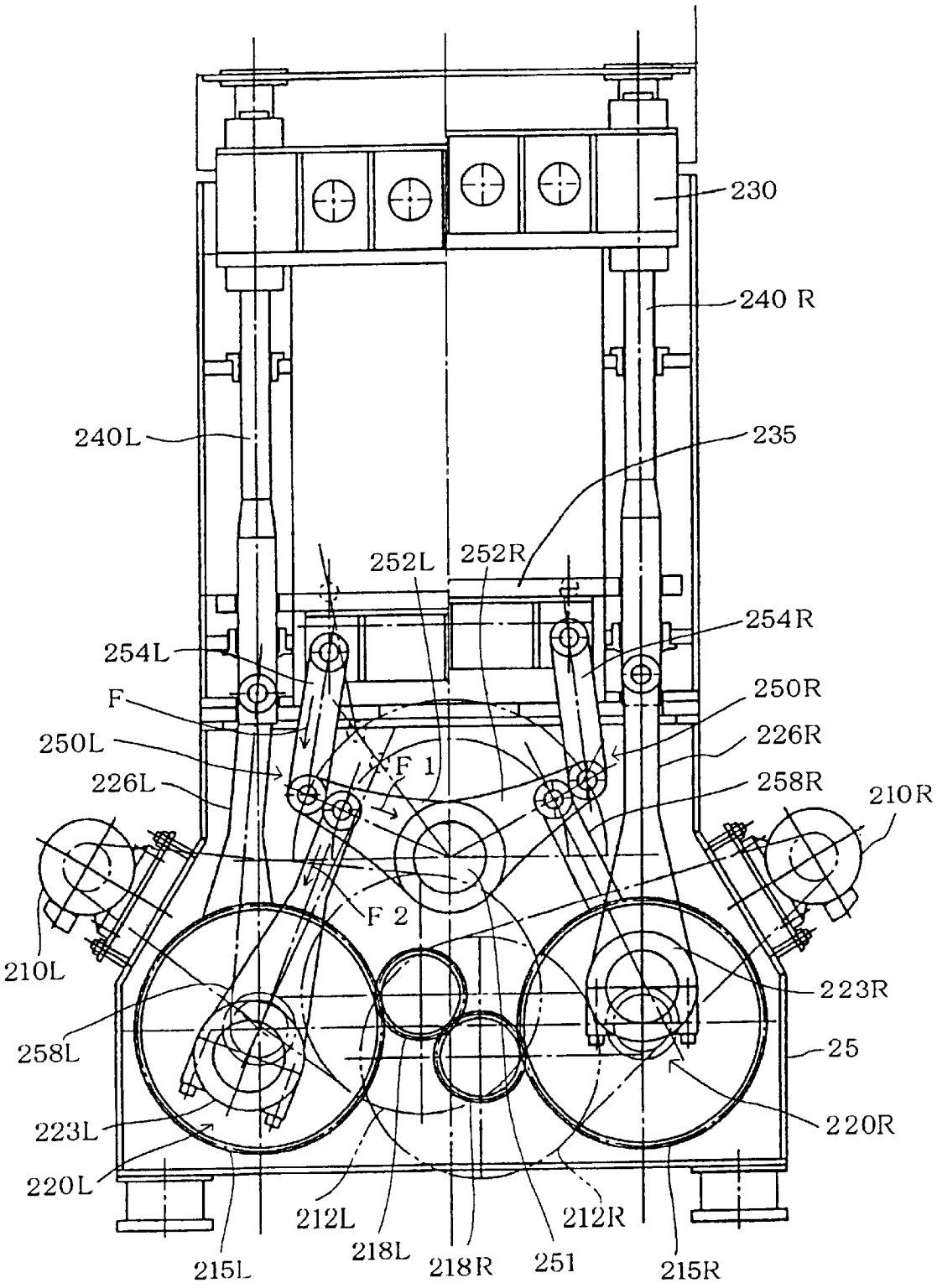
FIG. 14 is a front view of a double-action mechanical press constructed according to a third embodiment of the present invention.
Figure 15:
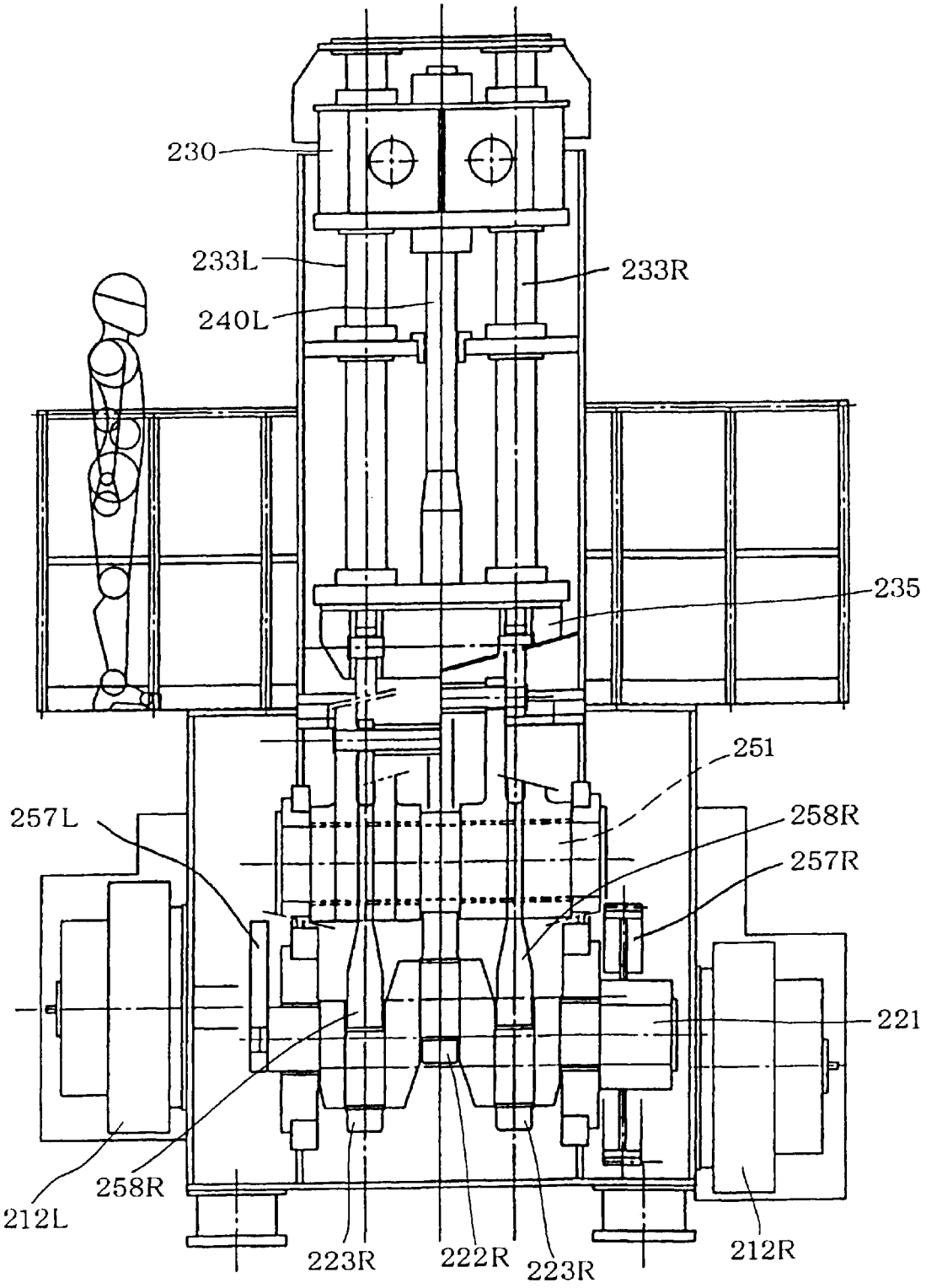
FIG. 15 is a side view of the double-action mechanical press shown in FIG. 14 as viewed from the right side.
Figure 16:
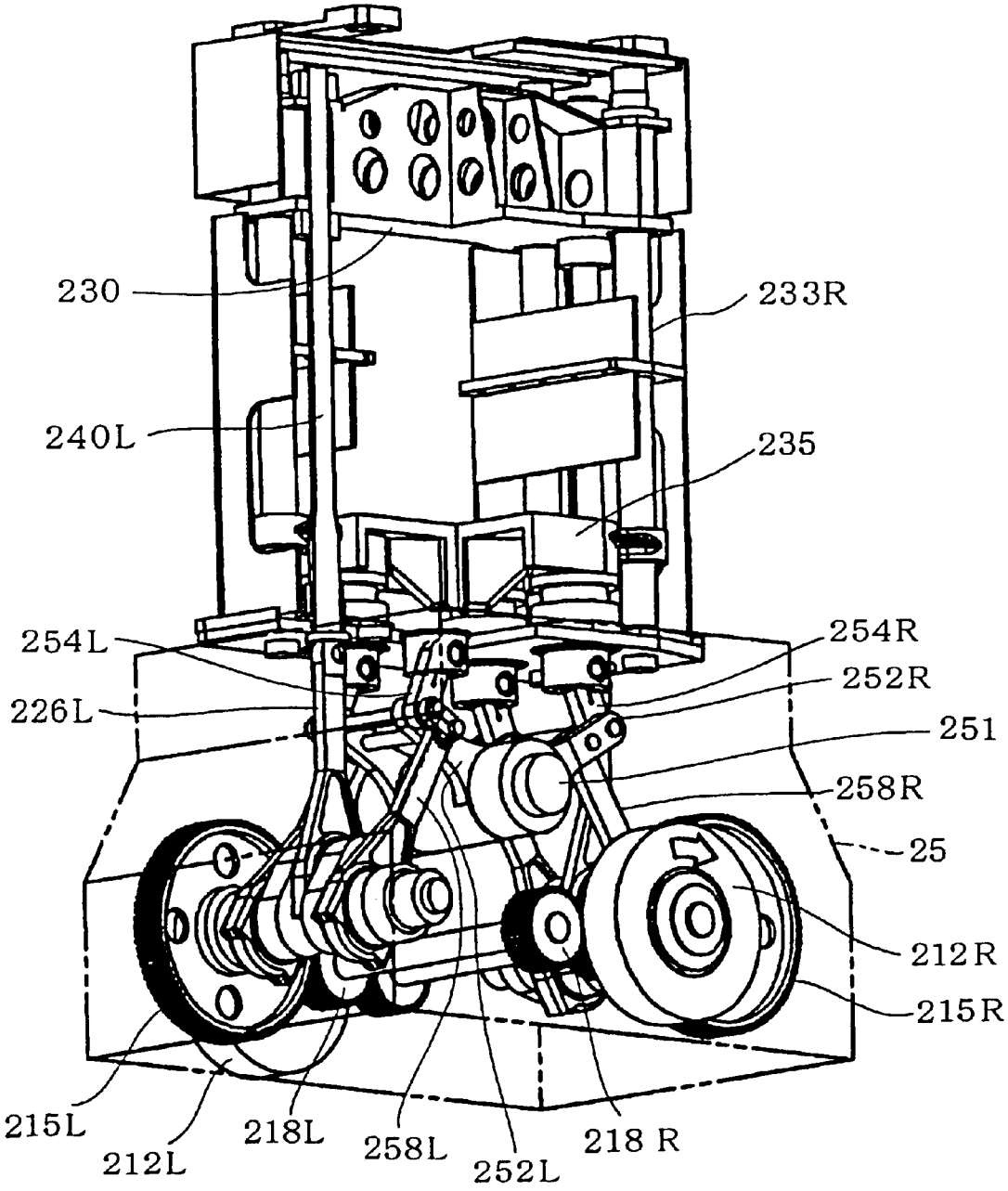
FIG. 16 is a schematic and perspective view of the double-action mechanical press according to the third embodiment of the present invention.

As shown in FIG. 14, thus, a reaction force F corresponding to the load from the lower ram 235 or a slider can be dispersed into components F1 and F2 toward the side of driving source. At the same time, the pressing operation can be increased in speed by rotating the second eccentric section 223L or 223R at an increased speed.

Figure 19:
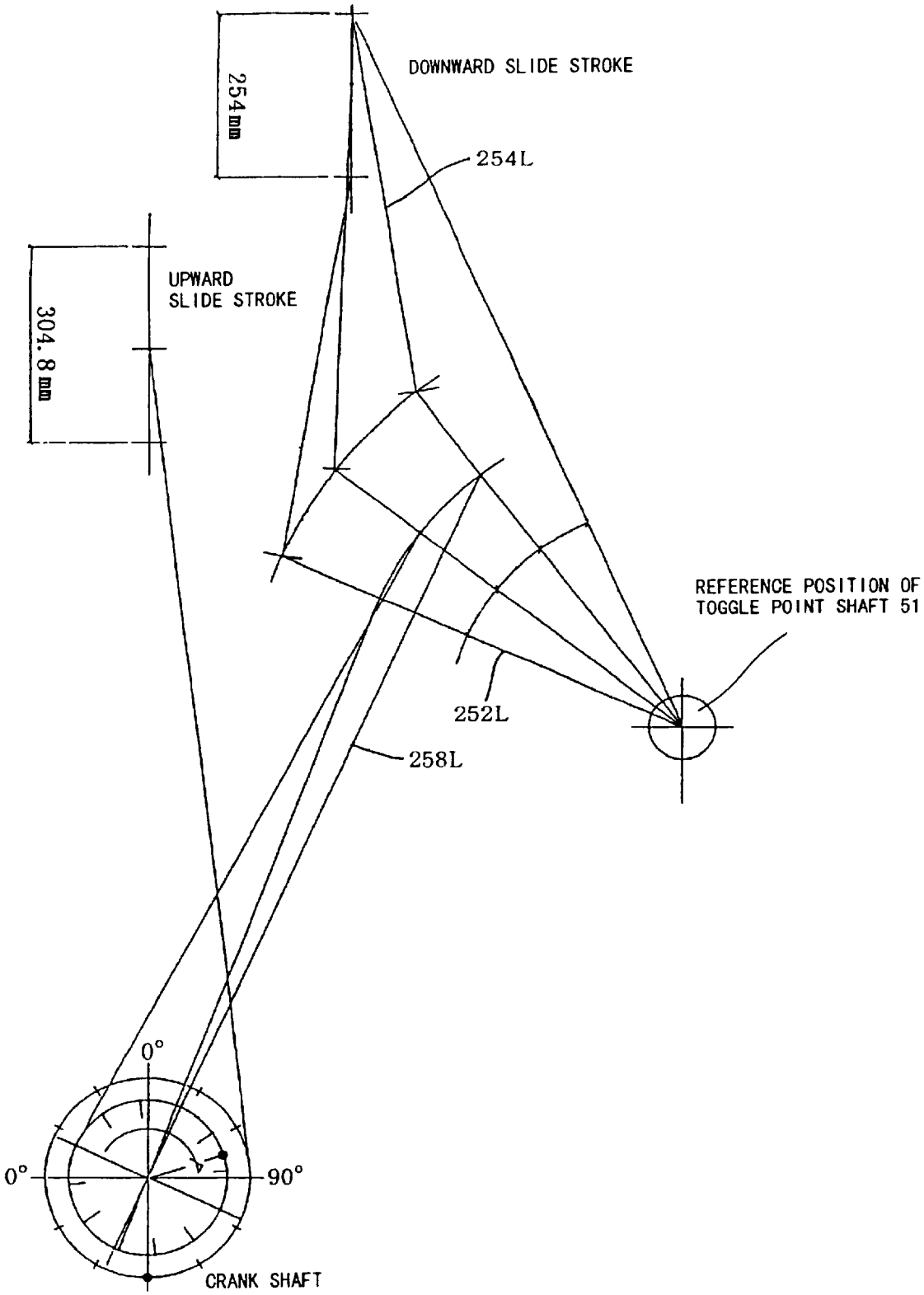
FIG. 19 is a view illustrating the slide strokes of the upper and lower rams in the third embodiment of the present invention.
Figure 20:
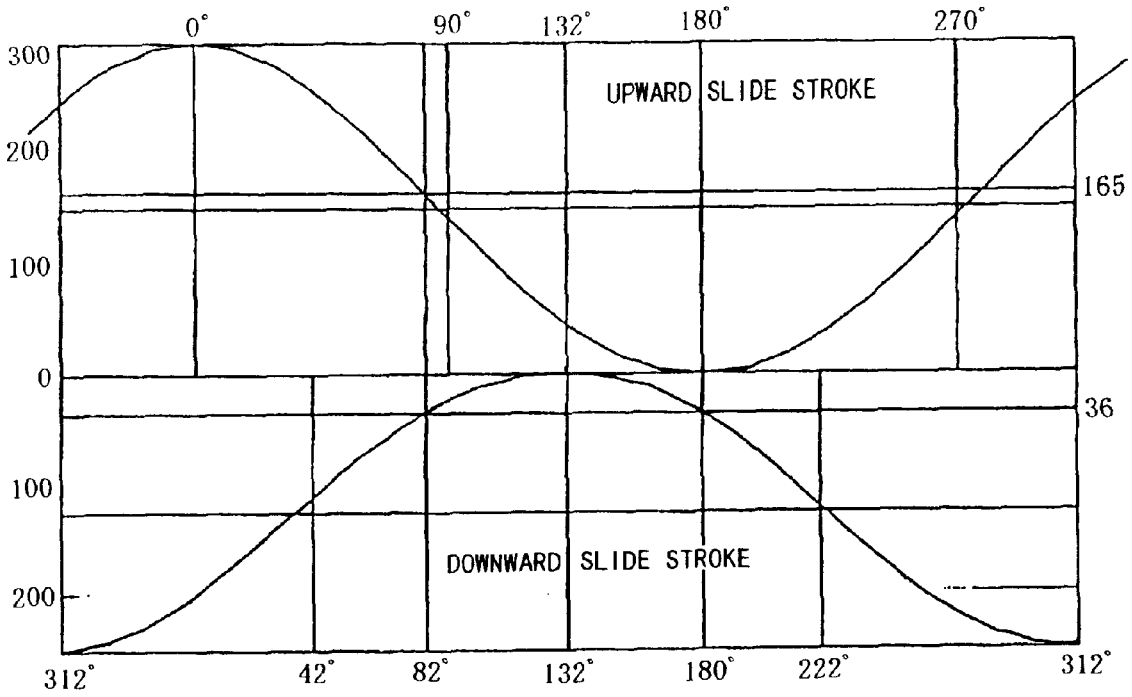
FIG. 20 is a graph illustrating the slide strokes of the upper and lower rams in the third embodiment of the present invention.

FIG. 19 shows the rotational angle in the crankshaft 221 of each of the two crank mechanisms 220L and 220R, the positions of the corresponding swing arm 252L or 252R, lower-ram-driving connecting rod 258L or 258R and connecting link 254L or 254R and the upward and downward motion stroke of the lower ram 235. FIG. 20 is a diagram of the slide strokes in the upper and lower rams 230, 235.

As will be seen from FIG. 20, the third embodiment is different from the first and second embodiments in that there is an extremely small area providing the upper retention position of the lower ram 235 to be a retention area. However, the lower ram 235 is slower in motion than that of a direct crank system in which a lower ram is connected directly to the eccentric portion of a crankshaft. This can improve the accuracy at the top dead center. Even if the retention area at the top dead center is smaller, the accuracy can be improved by providing a member of holding a can blank on the side of the upper ram 230.

Although the motion of the lower ram 235 is slower at the side of the top dead center, the acceleration G acting on the lower ram 235 is reversely increased on the side of the bottom dead center.

As the acceleration G increases, vibrations and noises will occur during the pressing process. This cannot avoid an reduction in yield. However, such a problem can be overcome by changing the motion and stroke of the lower ram 235 to reduce the acceleration G at the bottom dead center within a moldable range.

To this end, the third embodiment provides a single toggle point shaft 251 which is shared by the two toggle linkage mechanisms 250L and 250R and adjustable in the upward and downward directions. By adjusting the upward and downward positions of the toggle point shaft 251, the upper limit (or die-height) in a die fixedly mounted on the upper surface of the lower ram 235 can be changed to vary the motion and stroke of the lower ram 235.

Figure 17:
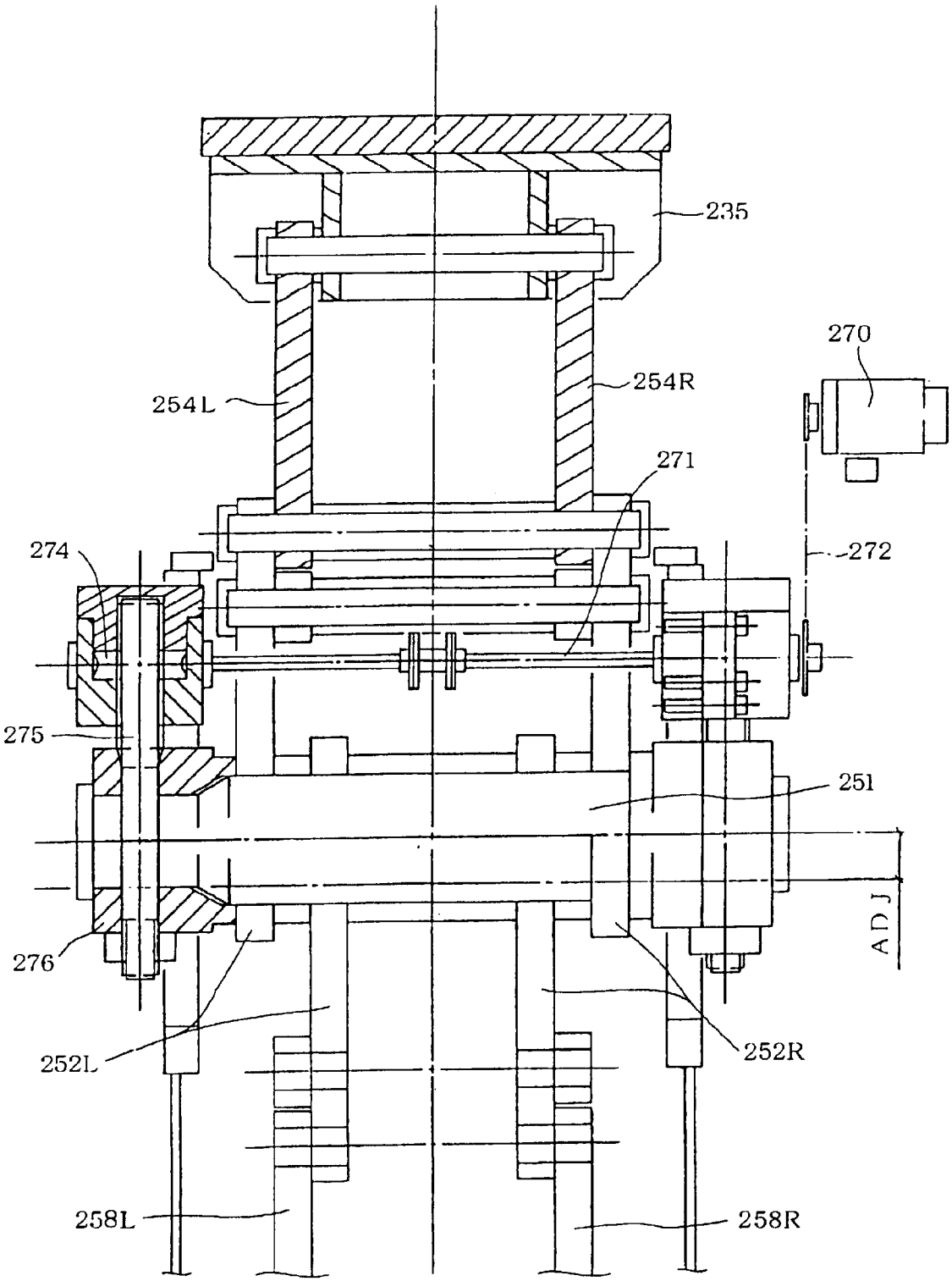
FIG. 17 is a front view of a position adjusting mechanism having a common toggle point shaft for two toggle linkage mechanisms.
Figure 18:
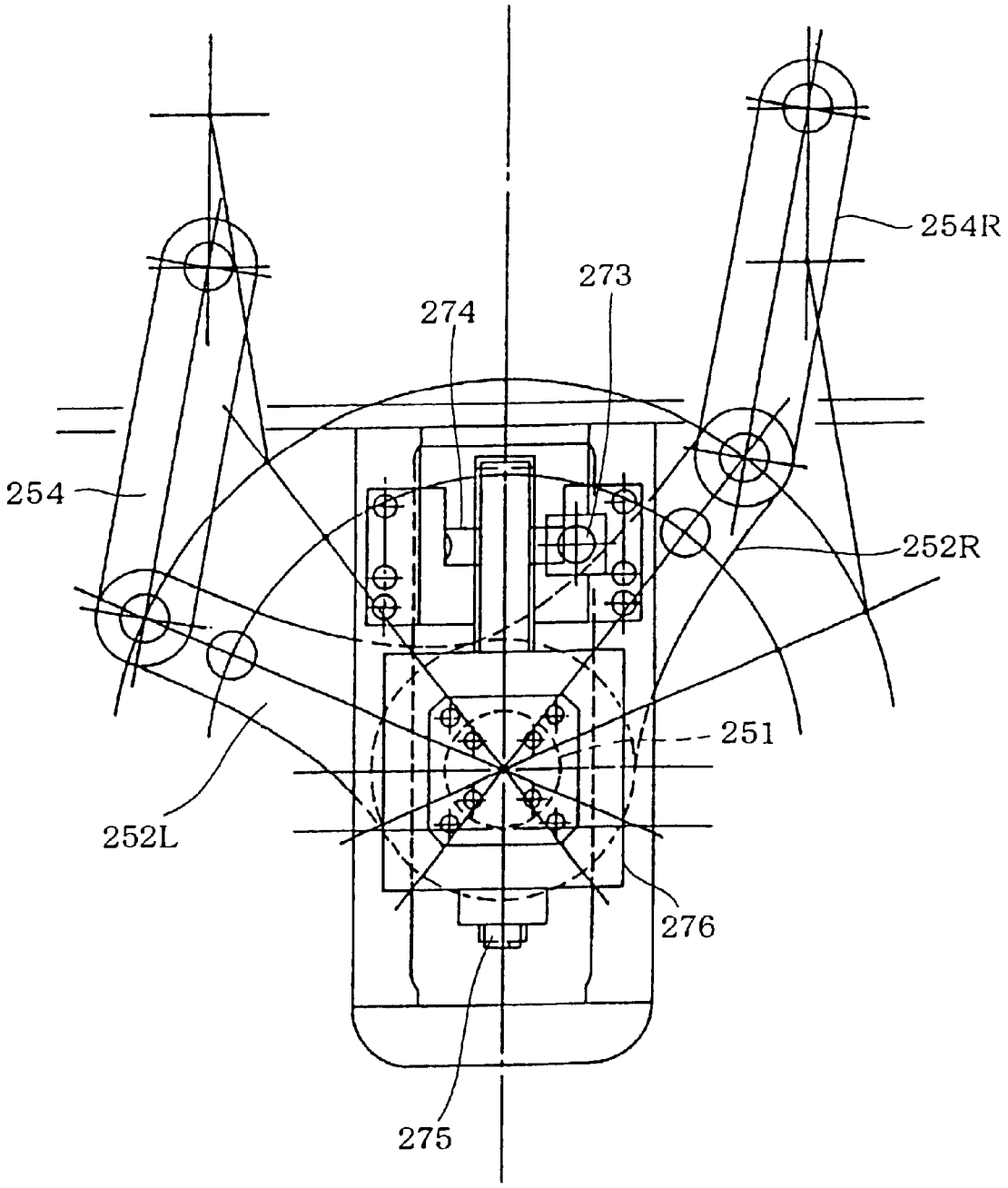
FIG. 18 is a side view of the mechanism shown in FIG. 17 as viewed from the right side.

As shown in FIGS. 17 and 18, the double-action mechanical press of the third embodiment comprises an adjusting motor 270, a shaft 271 located parallel to the toggle point shaft 251, a belt or chain 272 for transmitting the power from the adjusting motor 270 to the shaft 271, two worm gears 273 disposed on the both ends of the shaft 271, two wheels 274 meshing the respective worm gears, two adjusting screws 275 fixedly connected to the respective wheels 274, and two guide nut blocks 276 meshing the respective adjusting screws 275 and holding the toggle point shaft 251.

To adjust the upward and downward positions of the toggle point shaft 251, the adjusting motor 270 rotatable in reverse directions is rotated in one of the directions. The power of the adjusting motor 270 is transmitted to the two adjusting screws 275 through the belt or chain 272, shaft 271, the two worm gears 273 and the two wheels 274 to rotate the two adjusting screws 275. The guide nut blocks 276 are then moved in the upward and downward directions along the two adjusting screws 275. Thus, the toggle point shaft 251 held by the two guide nut blocks 276 is moved upward or downward in the upward and downward directions to adjust the upward and downward positions thereof.

Figure 21:
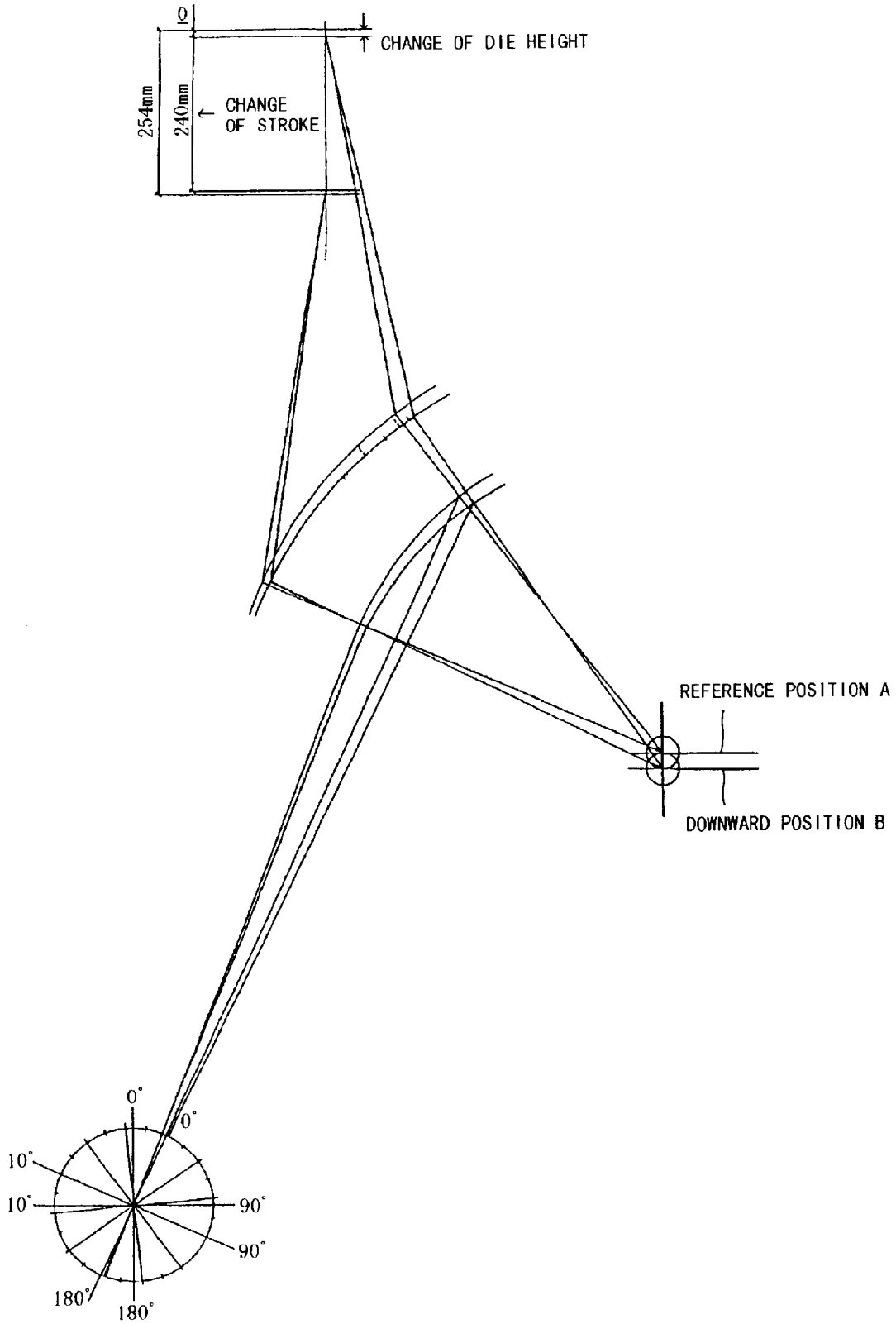
FIG. 21 is a view illustrating the slide strokes of the upper and lower rams in the third embodiment of the present invention before and after the toggle point shaft is changed.
Figure 22:
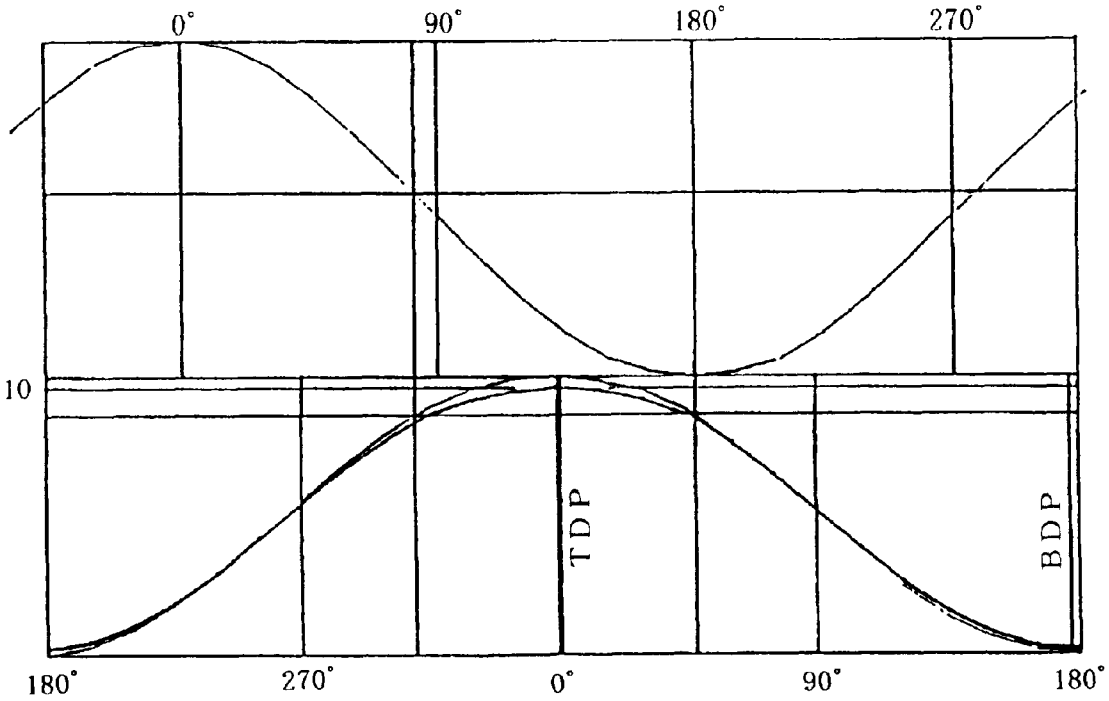
FIG. 22 is a graph illustrating the slide strokes of the upper and lower rams in the third embodiment of the present invention before and after the toggle point shaft is changed.

FIG. 21 schematically shows changes in the die height and in the upward and downward stroke of the lower ram 235 when the reference position A of the toggle point shaft 251 and the downward position below the reference position A by 25 mm are set. FIG. 22 is a diagram of slide stroke in the upper and lower rams 230, 235 when the position of the toggle point shaft has been adjusted. FIG. 22 clearly shows the fact that the stroke of the upper ram 230 is not changed while only the stroke of the lower ram 235 is changed. As best seen from FIGS. 21 and 22, the upper limit of the die fixedly mounted on the upper surface of the lower ram 235 is lowered by 10 mm when the toggle point shaft 251 is set at the downward position B. It can also be understood that the upward and downward stroke of the lower ram 235 is equal to 245 mm at the reference position A while the upward and downward stroke of the same is equal to 240 mm at the downward position B, thereby enabling the motion and stroke of the lower ram 235 to be changed.

When the toggle point shaft 251 is moved downward, the lower ram 235 tends to be retained at the top dead center as shown in FIG. 22. Therefore, the acceleration G at the bottom dead center correspondingly increases. Since the upward and downward stroke of the lower ram 235 is reduced, however, the maximum acceleration $G_{MAX}$ will accordingly be reduced to increase the speed of production (or yield).

When it is wanted to adjust the position of the toggle point shaft 251 for adjusting the die height, the amount of adjustment is equal to about ±5 mm. Therefore, even though the slide stroke of the lower ram 235 is changed simultaneously with the adjustment of die height, such a change may be neglected.

What is claimed is:

1. A double-action mechanical press comprising:

a driving source;

a crank mechanism driven by said driving source, said crank mechanism including a crankshaft which has two of first eccentric sections and two of second eccentric sections;

an upper ram being moved upward and downward by a power from said first eccentric sections;

a lower ram;

a plurality of upright rods for transmitting a power from each of said second eccentric sections in said crank mechanism to the lower ram;

two toggle linkage mechanisms each of which rotates in the opposite direction from each other in a vertical plane by the power inputted through said plurality of upright rods to move said lower ram in upward and downward directions, wherein the two toggle linkage mechanisms are symmetrically disposed by facing each other and synchronously rotated in right rotational direction and left rotational direction respectively about respective toggle points so that dynamic forces with respect to said rotations are counteracted; and two balance weights, each of which is coupled to each toggle linkage mechanism to keep an upward and downward motion balance in the lower ram.

2. The double-action mechanical press according to claim 1, wherein said driving source includes a pair of driving sources for applying a rotational force onto both ends of said crankshaft.

3. The double-action mechanical press according to claim 1, wherein said lower ram is movable upward and downward such that an upper position of the lower ram is a retention position.

4. A double-action mechanical press comprising:

a driving source;

two crank mechanisms driven by said driving source, each of said crank mechanisms including a crankshaft which has a main gear, a first eccentric section and a second eccentric section;

a plurality of upright rods for transmitting a power from said first eccentric section of each of said crank mechanisms;

an upper ram being moved upward and downward by the power from said plurality of upright rods;

a lower ram; and two toggle linkage mechanisms receiving the power from said second eccentric section of each of said crank mechanisms and rotating in the opposite direction from each other in a vertical plane to move said lower ram in upward and downward directions; and wherein said driving source includes a pair of driving sources each for applying a rotational power to each of said crankshafts, one of said pair of driving sources applying a rotational power to one of said crankshafts, and the other one of said pair of driving sources applying a rotational power to the other one of crankshafts;

two pinion shafts, each includes two pinion gears fixedly mounted thereon at each end of the pinion shafts; wherein the two pinion gears fixed at one end of each of said pinion shafts directly mesh with each other while another two pinion gears fixed at the other end of each of said pinion shafts directly mesh with each other; and wherein the main gear in one of the two crank mechanisms meshes with one of the two pinion gears, and the main gear in the other of the two crank mechanisms meshes with one of said another two pinion gears.

5. The double-action mechanical press according to claim 4, wherein:

each of said main gears includes a balance weight fixedly mounted thereon.

6. The double-action mechanical press according to claim 4, wherein each of said toggle linkage mechanisms has a balance weight.

7. The double-action mechanical press according to claim 4, wherein said lower ram is movable upward and downward such that an upper position of the lower ram is a retention position.

8. A double-action mechanical press comprising:

a driving source;

two crank mechanism driven by said driving source, each of said crank mechanisms including a first eccentric section and a second eccentric section;

an upper ram being moved upward and downward by a power from said first eccentric sections;

a lower ram; and two toggle linkage mechanisms receiving a power from said second eccentric section of each of said crank mechanisms and rotating in the opposite direction from each other in a vertical plane to move said lower ram in upward and downward directions, wherein said toggle linkage mechanisms have a common toggle point shaft; and wherein each of said toggle linkage mechanisms comprises, a swing arm swinging about said common toggle point shaft as a fulcrum;

a lower-ram driving connecting rod connecting said second eccentric section and said swing arm; and a connecting link connecting said lower ram and said swing arm, and wherein said swing arm, said lower-ram-driving connecting rod and said connecting link substantially form an inverted Y-shaped configuration.

9. The double-action mechanical press according to claim 8, further comprising mechanism for adjusting the upward and downward positions of said common toggle point shaft.

* * * * *